US005734391A

United States Patent [19]

Tanaka et al.

[11] Patent Number: 5,734,391

[45] Date of Patent: Mar. 31, 1998

[54] PRINTING SYSTEM

[75] Inventors: Hideki Tanaka, Yokohama; Katsuhiro Shirota, Inagi; Masayoshi Tachihara, Chofu; Ken Tsuchii, Sagamihara; Masashi Miyagawa; Genji Inada, both of Yokohama; Kosuke Yamamoto, Kawasaki, all of Japan

[73] Assignee: Canon Kabushiki Kaisha, Tokyo, Japan

[21] Appl. No.: 365,250

[22] Filed: Dec. 28, 1994

[30] Foreign Application Priority Data

Dec. 28, 1993 [JP] Japan ..... 5-337731
Dec. 28, 1993 [JP] Japan ..... 5-338260

[51] Int. Cl.[6] ..... B41J 2/01

[52] U.S. Cl. ..... 347/14; 347/7; 347/17

[58] Field of Search ..... 347/14, 17, 19, 347/7

[56] References Cited

U.S. PATENT DOCUMENTS

| | | | |
|---|---|---|---|
| 4,270,133 | 5/1981 | Shimazawa et al. | 347/7 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,175,565 | 12/1992 | Ishinaga et al. | 347/67 |
| 5,231,423 | 7/1993 | Wataya et al. | 347/18 |
| 5,270,730 | 12/1993 | Yaegashi et al. | 347/56 |
| 5,402,252 | 3/1995 | Kojima | 358/486 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 1235366 | 9/1989 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

In a printing apparatus using a plurality of heating elements as printing elements, there are provided CCD elements for storing electric charges whose quantity correspond to temperatures in correspondence to each of the printing elements, and for sequentially transferring these electric charges. As a printing head driving apparatus, an analog shift register having a series of CCD elements is employed in order to perform data transfer operation, data alignment, and driving operations of the respective printing elements. Also, the above-described CCD elements are commonly used with CCD elements for storing and transferring temperature data. As a result, a compact printing apparatus can be made while suppressing shading in images caused by temperature increasing due to the driving operation of the printing elements.

48 Claims, 18 Drawing Sheets

DURING DATA TRANSFER

DURING DATA OUTPUT

BEFORE DATA TRANSFER

DURING DATA TRANSFER

DURING DATA OUTPUT

PRINTING SYSTEM

BACKGROUND OF THE INVENTION

1. Field of the Invention

The present invention generally relates to a printing system. More specifically, the present invention is directed to a printing element information detecting apparatus, a printing head driving apparatus, and a printing apparatus, which is equipped with a printing head such as an ink jet head and a thermal printing head. The ink jet head ejects droplets of ink by utilizing various types of energy, for instance, thermal energy and mechanical energy. The thermal printing head is of thermal transfer, thermal sublimation, and thermal sensitive types.

2. Description of the Prior Art

Conventionally, in the printing apparatus employing the ink jet head, or thermal head having a plurality of printing elements, for instance in a recording apparatus, the printing head is driven under such a driving cycle that after the serially transferred recording data have been stored in the shift register, the recording operation is carried out at the desired timing. In particular, when the respective driving elements are driven at the different timings, for instance, when the gradation or half-tone recording operation and the driving corrections for the respective driving elements (will be referred to "bit corrections" hereinafter) are carried out, a large quantity of shift registers are required and these driving operations are carried out by the complex circuitry.

In the above-explained conventional recording apparatus, a temperature distribution would be produced within the recording head because of the driving duty distribution of the driving elements within the recording head and/or differences in the thermal boundary conditions. As a result, there is some possibility of a difference in density (concentration) of the output image. For example, it is known in the ink jet recording apparatus that a density non-uniformity or shading, or a variation thereof, in the image caused by variations in the ejected ink's volume happens to occur.

Concretely speaking, the shading may be classified as follows:

1) initial Shading: caused by differences in power given to ink when ink jet means within each of liquid paths is driven.
2) Temperature Increasing Shading: caused by a change in ink viscosity in connection with increased temperatures of ink jet head under drive, and/or a variation in power given by ink jet means.
3) Time-Lapse Shading: caused by that the initial fluctuation defined in item 1) is varied in connection with lapse of time.

The above-described shading 1) to 3) is not proper in view of stable condition in printing qualities. Under such a circumstance, the first and third shading could be reduced by the conventional head shading correction. This head shading correction technique is such an output image correcting method that, for instance, when the shading happens to occur, a preselected image pattern (test pattern) is outputted by the user; the shading is read out by employing a scanner or the like; and then the image processing method is adjusted based on this information.

However, this image correcting method owns such a problem that since the test pattern must be formed, the printing operation is interrupted by performing the head shading correction, resulting in lowering throughput.

Also, to solve the second problem, i.e., the temperature increasing shading, it is required to employ the technique for sensing the distribution of temperatures within the printing head, and also the technique for compensating for the temperatures within the printing head based on the detected temperature data.

To sense the temperature distribution according to the conventional methods, a plurality of temperature sensors are arranged within the printing head. Based upon the image pattern to be outputted, the temperatures within the recording head, which are changed in accordance with the time lapse, are detected. Preferably, the temperature distributions near the printing element with respect to the respective places are detected. However, in accordance with this conventional method, since a large number of sensors should be arranged within the recording head, the overall wiring connections thereof become complex. Accordingly, there is a problem that the density of arranging the driving elements could not be increased. Also, in accordance with the method for predicting the temperature distribution by sensing the drive duty, a heavy work load to calculate this drive duty is given to the controller employed in the recording apparatus. Accordingly, there is another problem that the driving speed is considerably lowered.

Similarly, these conventional methods own the below-mentioned drawbacks as to the temperature compensation. For instance, to achieve preferable temperature compensation, the bit correction should be executed with regard to either several bits of the driving elements, or a single driving element, and furthermore, these element driving conditions must be varied in response to the temporal changes in the temperature distributions within the recording head. However, in this case, very fine controls should be carried out in unit of several bits, or each of these recording elements. In such a specific case of the line type recording apparatus equipped with a large quantity of driving elements, very complex bit controls are necessarily required.

Furthermore, the same Assignee of this patent application has filed such a controlling method for evenly controlling all of driving elements in Japanese Patent Application Laying-open No. 31905/1989. However, according to this evenly controlling method, although the time-lapse variation in image density can be easily compensated, it is difficult to compensate in unit of bit within the recording head.

Further, in such a sort of driving apparatus for driving the printing head in response to the image data, a plurality of printing elements at the relative position between the printing head and the printing medium are driven at a preselected timing to perform a desired printing operation by the following manner. That is, the serial-transferred image data are aligned in the digital shift registers, the total number of which is corresponding to the number of printing elements, and are supplied to these printing elements at a predetermined timing.

However, such a conventional printing head driving apparatus for aligning the image data with employment of the digital shift registers has problems that as the number of printing elements is increased, the complex and costly circuit arrangement is required in this printing head driving apparatus. This problem would be further emphasized in such a condition that the different printing conditions are set to the respective printing elements. As a result, it is required to employ such a complex digital shift register that a plurality of circuit elements such as the storage elements are provided for each of the printing elements, resulting in complex circuitry.

To solve this complex circuitry problem, Japanese Patent Application Laying-open No. 285366/1989 has been proposed in which the analog shift register, the analog latch, the shift gate, and the driver and the like are mounted on the circuit.

Generally speaking, printing apparatuses require high density formation of pixels. In the ink jet type recording apparatus, for instance, the image formation at the pixel density of 8 to 16, or more, pixels per 1 millimeter is expected. The current ink jet type recording apparatuses could satisfy this requirement. In relation to such high printing density, higher circuit density for the printing element driving circuit and also the printing signal supplying circuit must be employed in the ink jet type recording apparatus.

As a consequence, large heat radiation is produced from these driving circuits during the image forming operation. When the above-described CCD circuit as shown in the above Japanese Patent Application Laying-open No. 285, 366/1989 is applied to the printing head driving apparatus of the image forming apparatus with high recording density, such a heat radiation aspect should be sufficiently considered.

That is, in such a printing head driving apparatus to which the CCD circuit is applied, when thermal energy is given to the CCD circuit portion, the dark current would become large due to this thermal adverse influence, which could not be neglected. As a result, unwanted electric charges different from those of the original signals are produced. Subsequently, if the true image data signals are entered into the CCD circuit, both the electric charges caused by the dark current and the electron charges caused by the true image signal are accumulated in the CCD circuit. Then, when these electric charges are discharged, such a different signal from the original image signal is transferred to the printing element, so that the image is erroneously formed. Therefore, the above-described Japanese Patent Application Laying-open No. 285366/1989 could not give any solution as to this heat radiation problem.

SUMMARY OF THE INVENTION

An object of the present invention is to solve at least one of the above-explained technical difficulties.

In a first aspect of the present invention, there is provided a printing element information detecting apparatus for detecting information about a plurality of printing elements of a printing head which contains as the printing element, a plurality of heating elements capable of producing thermal energy used to apply printing agent to a printing medium, the printing element information detecting apparatus comprising:

a plurality of temperature detecting means for detecting temperature information about the plurality of printing elements; and a plurality of CCD elements provided in correspondence with the plurality of temperature detecting means, for storing electric charges whose quantity is proportional to the temperature information, and for successively transferring the electric charges so as to serial-transfer the temperature information.

Both of the plural temperature detecting means and the plural CCD elements may be fabricated on a substrate on which the plurality of printing elements are formed.

Each of the plurality of temperature detecting means may be arranged near each of the printing elements.

In a second aspect of the present invention, there is provided a printing head driving apparatus comprising:

a printing element information detecting apparatus for detecting information about a plurality of printing elements of a printing head which contains as the printing element, a plurality of heating elements capable of producing thermal energy used to apply printing agent to a printing medium, the printing element information detecting apparatus having:

a plurality of temperature detecting means for detecting temperature information about the plurality of printing elements; and a plurality of CCD elements provided in correspondence with the plurality of temperature detecting means, for storing electric charges whose quantity is proportional to the temperature information, and for successively transferring the electric charges so as to serial-transfer the temperature information; and a shift register for aligning print data which is determined in accordance with the temperature information detected by the temperature detecting means and serial-transferred, in correspondence with an array of the plurality of printing elements contained by the printing head.

The shift register may be formed in an analog shift register having a plurality of CCD elements for sequentially transferring the electric charges.

The plurality of CCD elements included in the printing element information detecting apparatus may be commonly used with the plurality of CCD elements contained in the analog shift register.

In a third aspect of the present invention, the printing head driving apparatus may further comprise:

means for causing the plurality of CCD elements contained in the printing element information detecting apparatus to be discharged prior to the detection, and/or for causing the plurality of CCD elements contained in the analog shift register to be discharged prior to the transfer.

In a fourth aspect of the present invention, there is provided a printing apparatus for performing a printing operation with employment of an ink jet printing head having a plurality of ink jet ports for ejecting a liquid in response to a pressure effect and a plurality of printing elements for producing energy utilized to eject the liquid, the printing apparatus comprising:

pressure detecting means for detecting the pressure; and control means for controlling driving operations of the printing elements in response to information about the detected pressure.

Here, the ink jet printing head may own a plurality of liquid paths, one end of which is communicated with the ink ejecting port and the other end of which is communicated with a common liquid chamber;

the pressure detecting means may be arranged in the common liquid chamber; and the control means may acquire correction information used to control the driving operations of the printing elements in response to the information about pressure detected by the pressure detecting means when the plurality of printing elements are sequentially driven.

The printing element may have a form of a heating element for generating thermal energy to produce a bubble within the liquid path and for ejecting the ink in response to the bubble producing pressure.

The printing apparatus may further comprise:

a printing element information detecting apparatus for detecting information about a plurality of printing elements of a printing head which contains as the printing element, a plurality of heating elements capable of producing thermal energy used to apply printing agent to a printing medium, the printing element information detecting apparatus including:

a plurality of temperature detecting means for detecting temperature information about the plurality of printing elements; and a plurality of CCD elements provided in correspondence with the plurality of temperature detecting means, for storing electric charges whose quantity is proportional to the temperature information, and for successively transferring the electric charges so as to serial-transfer the temperature information.

The printing apparatus may further comprise:

a printing element information detecting apparatus for detecting information about a plurality of printing elements of a printing head which contains as the printing element, a plurality of heat radiating elements capable of producing thermal energy used to apply printing agent to a printing member, the printing element information detecting apparatus including:

a plurality of temperature detecting means for detecting temperature information about the plurality of printing elements; and a plurality of CCD (charge-coupled device) elements provided in correspondence with the plurality of temperature detecting means, for storing electric charges whose amount is proportional to the temperature information, and for successively transferring the electric charges so as to serial-transfer the temperature information; and a shift register for aligning print data which is determined in accordance with the temperature information detected by the temperature detecting means and serial-transferred, in correspondence with an array of the plurality of printing elements contained by the printing head.

In a fifth aspect of the present invention, there is provided a method for detecting information about a plurality of printing elements of a printing head which contains as the printing element, a plurality of heating elements capable of producing thermal energy used to apply printing agent to a printing medium, the method comprising the steps of:

providing a plurality of temperature detecting means;

providing a plurality of CCD elements in correspondence with the plurality of temperature detecting means;

detecting temperature information about the plurality of printing elements by the plurality of temperature detecting means;

storing electric charges whose quantity is proportional to the temperature information in the plurality of CCD elements; and successively transferring the electric charges so as to serial-transfer the temperature information by the plurality of CCD elements.

Here, both of the plural temperature detecting means and the plural CCD elements may be fabricated on a substrate on which the plurality of printing elements are formed.

Each of the plurality of temperature detecting means may be arranged near each of the printing elements.

In a sixth aspect of the present invention, there is provided a method for driving a printing head comprising the steps of:

detecting information about a plurality of printing elements of a printing head which contains as the printing element, a plurality of heating elements capable of producing thermal energy used to apply printing agent to a printing medium, the detecting method having the steps of:

providing a plurality of temperature detecting means;

providing a plurality of CCD elements in correspondence with the plurality of temperature detecting means;

detecting temperature information about the plurality of printing elements by the plurality of temperature detecting means;

storing electric charges whose quantity is proportional to the temperature information in the plurality of CCD elements; and successively transferring the electric charges so as to serial-transfer the temperature information by the plurality of CCD elements;

providing a shift register; and aligning print data which is determined in accordance with the temperature information detected by the temperature detecting means and serial-transferred by the plurality of CCD elements, in correspondence with an array of the plurality of printing elements contained by the printing head, by using the shift register.

Here, the shift register may be formed in an analog shift register having a plurality of CCD elements for sequentially transferring the electric charges.

The plurality of CCD elements included in the printing element information detecting apparatus may be commonly used with the plurality of CCD elements contained in the analog shift register.

A printing head driving method may further comprise at least one of the steps of causing the plurality of CCD elements contained in the printing element information detecting apparatus to be discharged prior to the detection, and causing the plurality of CCD elements contained in the analog shift register to be discharged prior to the transfer.

In a seventh aspect of the present invention, there is provided a printing method for performing a printing operation with employment of an ink jet printing head having a plurality of ink jet ports for ejecting a liquid in response to a pressure effect and a plurality of printing elements for producing energy utilized to eject the liquid, the printing method comprising the steps of:

detecting the pressure; and controlling driving operations of the printing elements in response to information about the detected pressure.

Here, the ink jet printing head may have a plurality of liquid paths, one end of which is communicated with the ink ejecting port and the other end of which is communicated with a common liquid chamber;

means for detecting the pressure may be arranged in the common liquid chamber; and in the controlling step correction information used to control the driving operations of the printing elements may be acquired in response to the information about pressure detected by the pressure detecting means when the plurality of printing elements are sequentially driven.

The printing element may be a form of a heating element for generating thermal energy to produce a bubble within the liquid path and for ejecting the ink in response to the bubble producing pressure.

A printing method may further comprise the step of:

detecting information about a plurality of printing elements of a printing head which contains as the printing element, a plurality of heating elements capable of producing thermal energy used to apply printing agent to a printing medium, the detecting step including the steps of:

providing a plurality of temperature detecting means;

providing a plurality of CCD elements in correspondence with the plurality of temperature detecting means;

detecting temperature information about the plurality of printing elements by the plurality of temperature detecting means;

storing electric charges whose quantity is proportional to the temperature information in the plurality of CCD elements; and successively transferring the electric charges so as to serial-transfer the temperature information by the plurality of CCD elements.

The printing method may further comprise the step of:

detecting information about a plurality of printing elements of a printing head which contains as the printing element, a plurality of heat radiating elements capable of producing thermal energy used to apply printing agent to a printing member, the printing element information detecting apparatus including the steps of:

providing a plurality of temperature detecting means;

providing a plurality of CCD elements in correspondence with the plurality of temperature detecting means;

detecting temperature information about the plurality of printing elements by the plurality of temperature detecting means;

storing electric charges whose amount is proportional to the temperature information in the plurality of CCD elements; and successively transferring the electric charges so as to serial-transfer the temperature information by the plurality of CCD elements;

providing a shift register; and aligning print data which is determined in accordance with the temperature information detected by the temperature detecting means and serial-transferred by the plurality of CCD elements, in correspondence with an array of the plurality of printing elements contained by the printing head, by using the shift register.

In an eighth aspect of the present invention, there is provided a printing head driving apparatus comprising:

an analog shift register including a plurality of CCD elements for aligning print data which is serial-transferred, in correspondence with an arrangement of plural printing elements owned by a printing head; and means for causing the plurality of CCD elements to be discharged prior to the serial transfer operation of the print data.

Here, the printing head may be in the form of an ink jet head in which a plurality of ink jet ports are arranged.

The printing head includes means for producing thermal energy utilized to apply a printing agent to a printing medium.

In a ninth aspect of the present invention, there is provided a printing head driving apparatus comprising:

an analog shift register including a plurality of CCD elements for aligning print data which is serial-transferred, in correspondence with an arrangement of plural printing elements owned by a printing head; and means for transferring to the plurality of CCD elements, a group of data in response to driving energy data determined for each of the plural printing elements.

Here, the driving energy data may be a pulse width.

Each of the plural printing elements may be driven by subdivided plural times so as to form a single pixel; and the driving energy may correspond to a value obtained by multiplying a width of a driving pulse per one time, which is uniformly determined as to the plurality of printing elements, by the number of driving determined as to each of the plurality of printing elements.

The printing head driving apparatus may further comprise:

means for causing the plurality of CCD elements to be discharged prior to transfer operation of the print data.

The printing head may be in the form of an ink jet head in which a plurality of ink jet ports are arranged.

The printing head may include means for producing thermal energy utilized to apply a printing agent to a printing medium.

In a tenth aspect of the present invention, there is provided a printing apparatus comprising:

an analog shift register including a plurality of CCD elements for aligning print data which is serial-transferred, in correspondence with an arrangement of plural printing elements of a printing head;

means for causing the plurality of CCD elements to be discharged prior to the serial transfer operation of the print data; and means for relatively transporting a printing medium to a printing head.

In an eleventh aspect of the present invention, there is provided a printing apparatus comprising:

an analog shift register including a plurality of CCD elements for aligning print data which is serial-transferred, in correspondence with an arrangement of plural printing elements of a printing head;

means for transferring to the plurality of CCD elements, a group of data in response to driving energy determined for each of the plural printing elements; and means for relatively transporting a printing medium to a printing head.

In a twelfth aspect of the present invention, there is provided a method for driving a printing head comprising the steps of:

providing an analog shift register including a plurality of CCD elements;

aligning print data which is serial-transferred, in correspondence with an arrangement of plural printing elements of a printing head, by using the analog shift register; and causing the plurality of CCD elements to be discharged prior to the serial transfer operation of the print data.

The printing head may be in the form of an ink jet head in which a plurality of ink jet ports are arranged.

The printing head may include means for producing thermal energy utilized to apply a printing agent to a printing medium.

In a thirteenth aspect of the present invention, there is provided a method for driving a printing head comprising the steps of:

providing an analog shift register including a plurality of CCD elements;

aligning print data which is serial-transferred, in correspondence with an arrangement of plural printing elements of a printing head, by using the analog shift register; and transferring to the plurality of CCD elements, a group of data in response to driving energy data determined for each of the plural printing elements.

Here, the driving energy data may be a pulse width.

Each of the plural printing elements may be driven by subdivided plural times so as to form a single pixel; and the driving energy may correspond to a value obtained by multiplying a width of a driving pulse per one time, which is uniformly determined as to the plurality of printing elements, by the number of driving determined as to each of the plurality of printing elements.

A printing head driving method may further comprise the step of causing the plurality of CCD elements to be discharged prior to transfer operation of the print data.

The printing head may be in the form of an ink jet head in which a plurality of ink jet ports are arranged.

The printing head may include means for producing thermal energy utilized to apply a printing agent to a printing medium.

In a fourteenth aspect of the present invention, there is provided a printing method comprising the steps of:

providing an analog shift register including a plurality of CCD elements;

aligning print data which is serial-transferred, in correspondence with an arrangement of plural printing elements of a printing head, by using the analog shift register;

causing the plurality of CCD elements to be discharged prior to the serial transfer operation of the print data; and relatively transporting a printing medium to a printing head, by using the analog shift register.

In a fifteenth aspect of the present invention, there is provided a printing method comprising:

providing an analog shift register including a plurality of CCD elements;

aligning print data which is serial-transferred, in correspondence with an arrangement of plural printing elements of a printing head, by using the analog shift register;

transferring to the plurality of CCD elements, a group of data in response to driving energy determined for each of the plural printing elements; and relatively transporting a printing medium to a printing head.

As previously described, in accordance with one aspect of the present invention, the initial shading is corrected based upon the pressure values detected by the pressure sensor, and/or the temperature increasing shading as well as the time-lapse shading are corrected in accordance with the amount of electric charges stored in the CCD elements. As a consequence, an image without shading or density non-uniformity can be printed out while maintaining the better image quality.

Also, according to another aspect of the present invention, the printing head driving apparatus employs such an analog shift register equipped with a series of CCD elements in order that the image data are transferred, aligned, and driven in correspondence with the respective printing elements. Furthermore, this CCD element is commonly used with such a CCD element capable of storing and transferring the temperature data, so that a compact printing head driving apparatus with low cost can be achieved.

According to a further aspect of the invention, since the electric charges stored in the CCD elements are discharged prior to the transfer operation of the data to be printed out, such unnecessary charges stored in these CCD elements, caused by the dark current, can be previously discharged, so that a desired image with better image quality can be printed out.

According to a still further aspect of the present invention, since the data corresponding to the drive energy determined to each of the CCD elements is set to the respective CCD elements, even when the different driving conditions are set to the respective printing elements and also the data used for the gradation display is set, the entire circuit arrangement of the driving circuit can be made simple.

BRIEF DESCRIPTION OF THE DRAWINGS

For a better understanding of the present invention, reference is made of the detailed description to be read in conjunction with the accompanying drawings, in which.

DETAILED DESCRIPTION OF THE PREFERRED EMBODIMENTS

Figure 1:
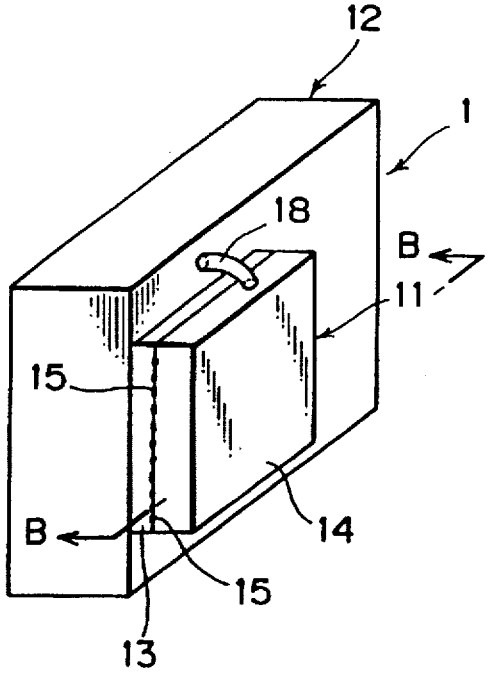
FIG. 1 is a perspective view for representing a structure of an ink jet head as an example of a printing head to which the present invention is applicable.

Referring now to the drawings, various embodiments of the present invention will be described in detail.

[FIRST EMBODIMENT]

FIG. 1 schematically shows a structure of an ink jet type printing head as an example of a printing head used in this first embodiment of the present invention. This ink jet type printing head is equipped with ink jet ports or orifices for ejecting droplets of ink by utilizing thermal energy, namely a so-called "Bubble Jet Printing Head" proposed by CANON Co., Ltd. This printing head is fabricated in such a manner that a nozzle plate is joined to a base plate on which a heater for generating the above-described thermal energy is mounted. The reference numerals will be described later, with a description of FIG. 6.

Figure 2:
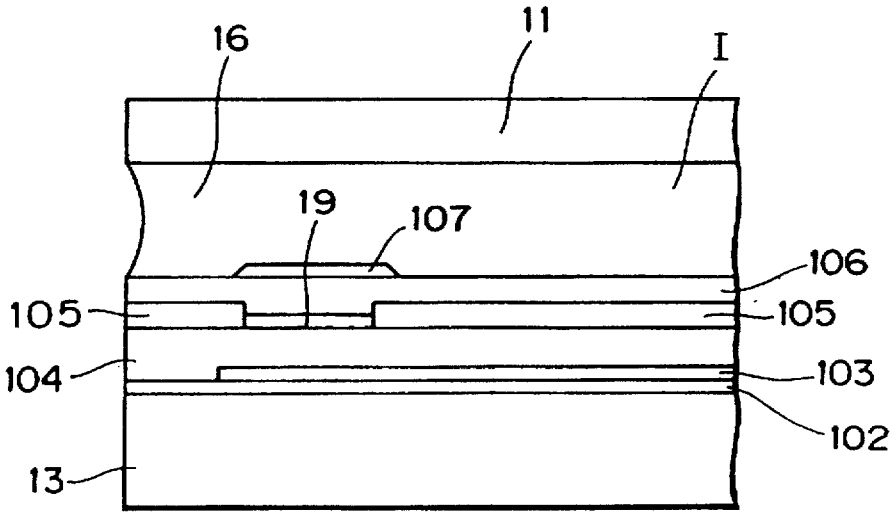
FIG. 2 is a sectional view for showing a liquid path portion of the ink jet head indicated in FIG. 1.
Figure 3:
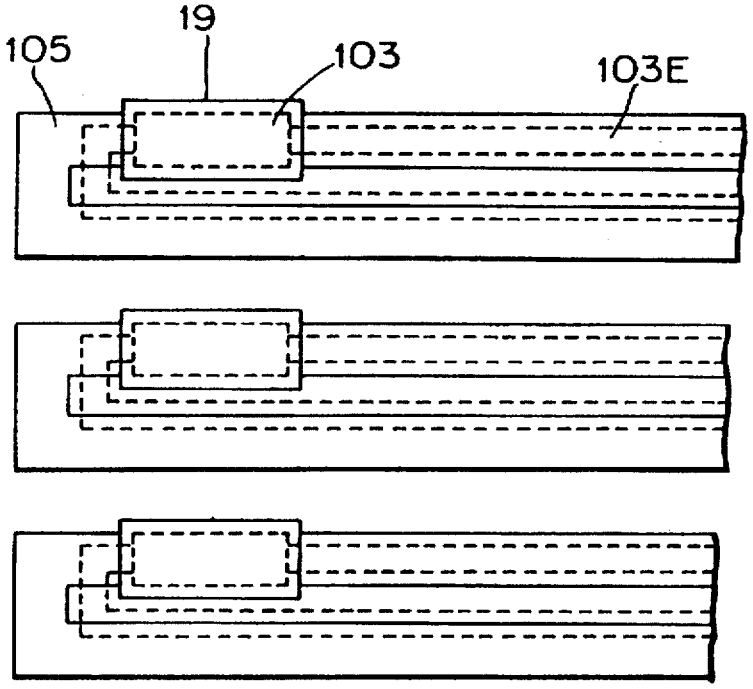
FIG. 3 is a plan view for indicating a base plate portion of the ink jet head.

In FIG. 2, there is shown a sectional view of the printing head, taken along a line B—B of FIG. 1. In FIG. 3, there is indicated a top view for showing the base plate of this printing head.

In FIGS. 2 and 3, an aluminum (Al) pattern functioning as temperature sensor 103 and electrodes thereof 103E are formed via a silicon oxide ($SiO_2$) film functioning as a head storage layer 102 on an Si substrate 13. Furthermore, both aluminum electrodes 105 and layers made of $HfB_2$ functioning as ejecting heaters 19 are provided via an insulating layer 104 made of $SiO_2$ on this aluminum pattern. Also, a layer of $SiO_2$ corresponding to a protection layer 106, and layers of Ta functioning as heater protection members 107 are fabricated on the aluminum electrodes 105 and the ejecting heaters 19. These layers are manufactured by way of the semiconductor manufacturing process. Now, when a current is supplied via the aluminum electrode 105 to the ejecting heater 19, film boiling occurs in ink "T" on the Ta layer, thereby forming a bubble. As a result, an ink droplet is ejected from each of the orifices via a liquid path 16 constituted by the aluminum electrode 105 and a glass plate 11. The aluminum sensor 103 can detect temperatures near the heater in real time in unit of bit. Then, the detected data is charged into the CCD element (will be described below).

It should be noted that the temperature sensor may be realized by employing such a means capable of detecting either temperatures, or a change in temperatures by utilizing a variation in electric resistance values thereof. It is also apparent that when the temperatures just before formation of bubble can be detected by the temperature sensors, these temperature sensors are not limited to the above-described conditions, namely positions, structures, and materials.

Figure 4:
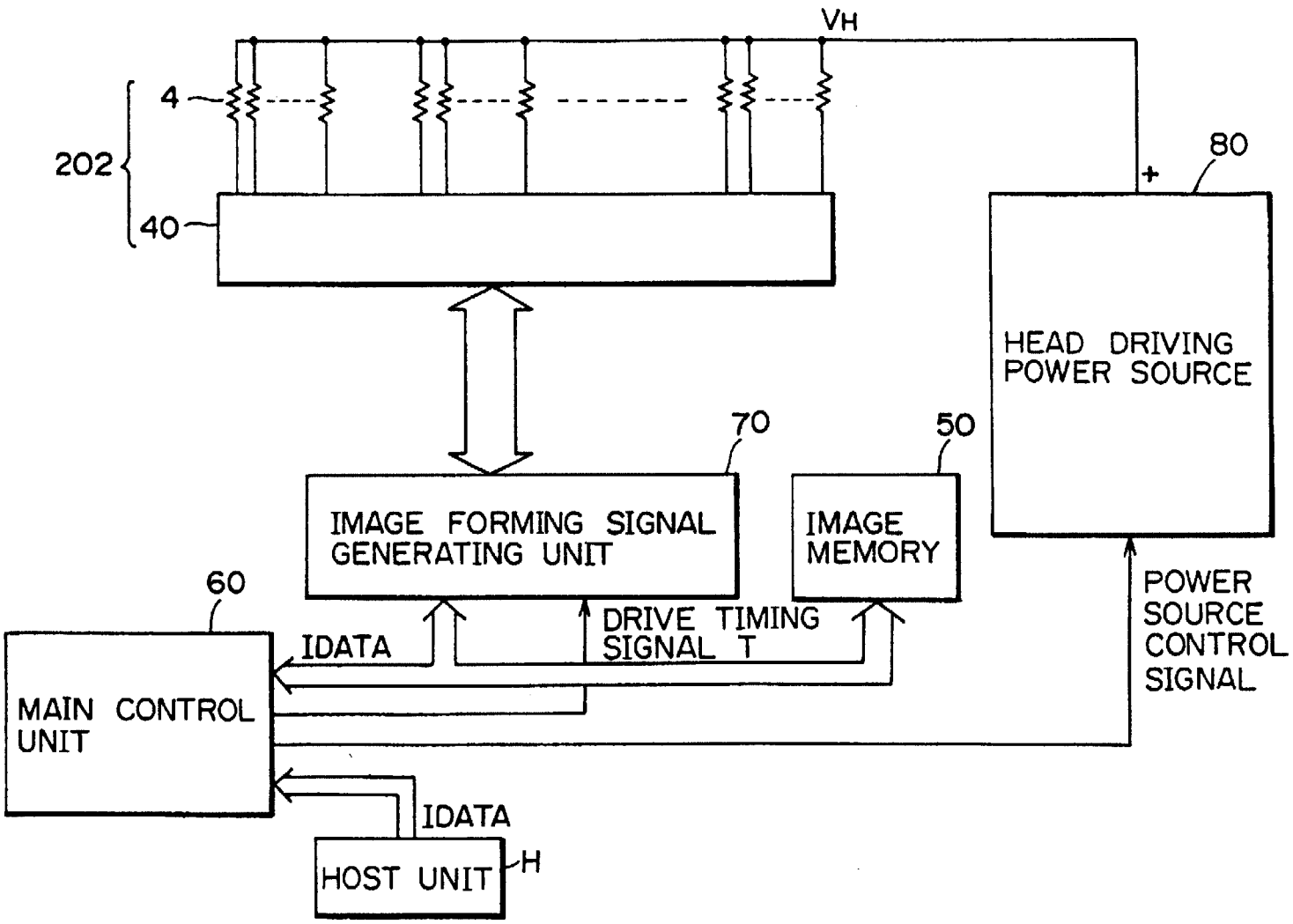
FIG. 4 schematically indicates a block diagram of a control system for controlling the ink jet head.

FIG. 4 schematically indicates an example of an arrangement of a control system for controlling a recording head with the above-described structure. In this drawing, reference numeral 202 indicates a recording head having a group of heating resistive members (heaters) 19, and a driving circuit 40 thereof. The recording head 202 is fabricated on the substrate 13 shown in FIG. 2.

Reference numeral 50 shows an image memory, for storing image data "IDATA" which is directly supplied from a host unit "H" functioning as an image data supplying source, or supplied via a main control unit 60 of the recording apparatus. Reference numeral 70 denotes an image forming signal generating unit for reading out printing element information from a printing element information detecting apparatus provided within a driving circuit 40, and for transferring the read printing element information to the main control unit 60. Further, this image forming signal generating unit 70 reads out the image data stored in the image memory 50 so as to generate a control signal to the printing element information detecting apparatus, a data signal "DATA" corresponding to the driving energy determined with respect to each of the heating elements, a clock signal used to define a transfer timing, and also a signal for driving the heating elements. These signal generations by the image forming signal generating unit 70 are carried out in response to a drive timing signal "T" derived from the main control unit 60. Finally, reference numeral 80 shows a head driving power source for applying a preselected voltage to a common electrode $V_H$ during the recording operation.

Figure 5:
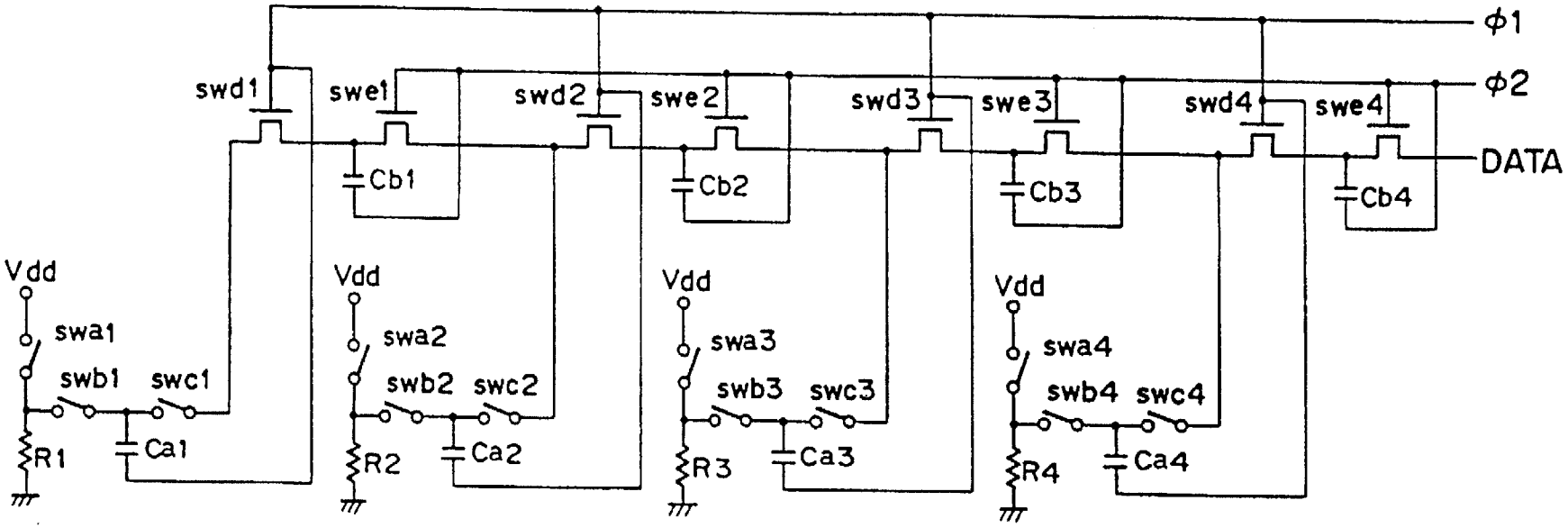
FIG. 5 is a circuit diagram of a detecting apparatus employed in the head driving circuit of FIG. 4, which detects fluctuation in temperature increasing.

FIG. 5 is a circuit diagram of a detecting apparatus for detecting an image shading caused by temperature increasing, which is provided within the above-described head driving circuit 40.

In FIG. 5, symbols swa, swb, swc, swd and swe indicate switches. Among them, the switches swd and swe are turned ON/OFF in response to a signal ø1 and a signal ø2 entered from the main control unit 60 via the image forming signal generating unit 70. On the other hand, the switches swa, swb and swc are turned ON/OFF in accordance with the respective sequences of the main control unit 60. Symbols Ca and Cb indicate CCD (charge-coupled device) elements having capacitors into which electric charges are stored. Symbols R1 to Rn represent temperature sensors made of aluminum, fabricated adjacent to nozzles.

First, the switching conditions of these switches are given as follows in the initial stage where the temperatures are detectable:

swa1 to swan: OFF
swb1 to swbn: ON
swc1 to swcn: OFF
swd1 to swdn: ON
swe1 to swen: OFF.

That is to say, under initial condition, no charges are stored into the CCD elements Ca1 to Can, and Cb1 to Cbn.

Next, a current is supplied to the heater 19 in response to the recording signal. As a result, bubble is formed on each of the heaters, and then ink is ejected by way of the pressure produced from this bubble.

Thereafter, the switching conditions of these switches are changed as follows:

swa1 to swan, swb1 to swbn: ON
swc1 to swcn: OFF
swd1 to swan, swe1 to swen: OFF.

whereby, the electron charges proportional to the amounts of currents flowing through the resistors R1 to Rn are charged into the respective CCD elements Ca1 to Can (actually, charge amounts caused by resistance changes due to temperature variations).

Subsequently, the switches swa1 to swan and swb1 to swbn are turned OFF, the switches swc1 to swcn are turned ON. Signals ø1 and ø2 having phases different from each other by 180 degrees are supplied to the CCD elements, so that the switches swd1 to swdn and swe1 to swen are turned ON/OFF. Then, the CCD elements Ca1 to Can, Cb1 to Cbn function as analog shift registers, and therefore sequentially transfer the analog signals from the terminal "DATA" to the main control unit 60.

Based upon these transferred signals, the energy of the driving signals supplied to the respective heaters 19, for instance, a width or a voltage of a pulse signal, is appropriately adjusted so that the amount of ejecting ink is compensated to be constant and uniform. Another compensating process is available such that before applying a pulse signal capable of producing bubble in the ink (will be referred to as a "main heat pulse" hereinafter), such a pulse signal not for producing bubble in the ink (will be referred to as a "preheat pulse" hereinafter) is properly applied so as to preheat the ink, whereby the amount of ejecting ink is compensated to be constant and uniform irrelevant to the temperature distributions and/or unevenness in the dimensions of the ink ejecting ports. Moreover, prior to this compensation, both of the width of the preheat pulse and the interval between the main heat pulse and the preheat pulse are properly changed, depending upon the electro-thermal converting members.

When a detection is made of such a voltage having a value higher than a predetermined value in the respective bits (heating elements), it is so judged that no ink droplets are ejected, or ink ejection failure happens to occur in the corresponding liquid paths. As a consequence, proper recovery operation can be done.

As described above, since the temperature sensor 103 is provided in correspondence with each of the heating elements and the temperature detected information is charged into the CCD elements, it is possible to detect and correct the temperatures in unit of desirable quantity of heating elements. Also, since these temperature detecting and correcting operations can be completed within a very short time, it is possible to avoid occurrences of image shading caused by a change in the temperature distributions of the printing head. As a result, the better images without any image shading can be produced.

Subsequently, a description will now be made of corrections for initial shading and time-lapse fluctuation. Both the initial and time-lapse shading may be corrected by controls based on detection values obtained from pressure detecting means.

Figure 6:
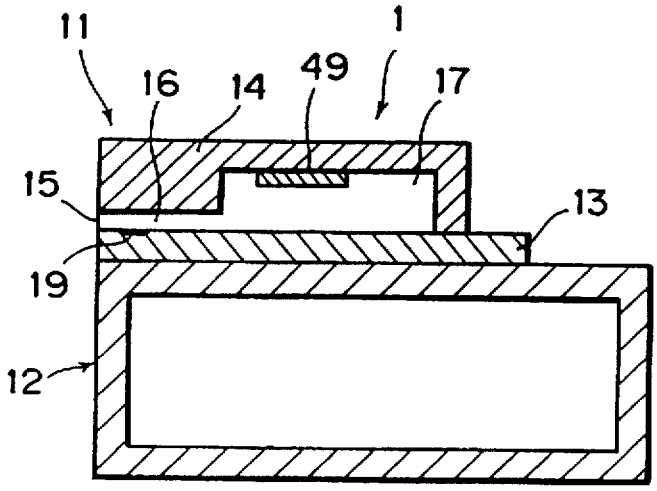
FIG. 6 is a sectional view of the ink jet head containing a liquid chamber, taken along a line B—B of FIG. 1.

First, this pressure detecting means will now be explained with reference to FIG. 1 and FIG. 6. FIG. 6 is a cross-sectional view for showing the ink jetting type printing head, taken along a line B—B of FIG. 1. In FIG. 6, reference numeral 15 indicates a fluid path having an opening for jetting droplets of ink. As shown in FIG. 1, there are provided a plurality (for instance, 128) of fluid paths. Reference numeral 12 shows an ink tank for storing the ink, and reference numeral 18 indicates an ink tube for connecting the ink tank 12 with the printing head 1. Reference numeral 49 denotes a pressure sensor provided within a common fluid chamber 17 for communicating with the respective fluid paths 15, and being made of PZT (piezoelectric transducer) or crystal. This pressure sensor converts pressure into an electric signal, and this pressure is propagated via the ink when bubble is produced above the heater.

A description will now be made of an ejection correcting operation for detecting pressure and for correcting initial shading with this arrangement.

Figure 7B:
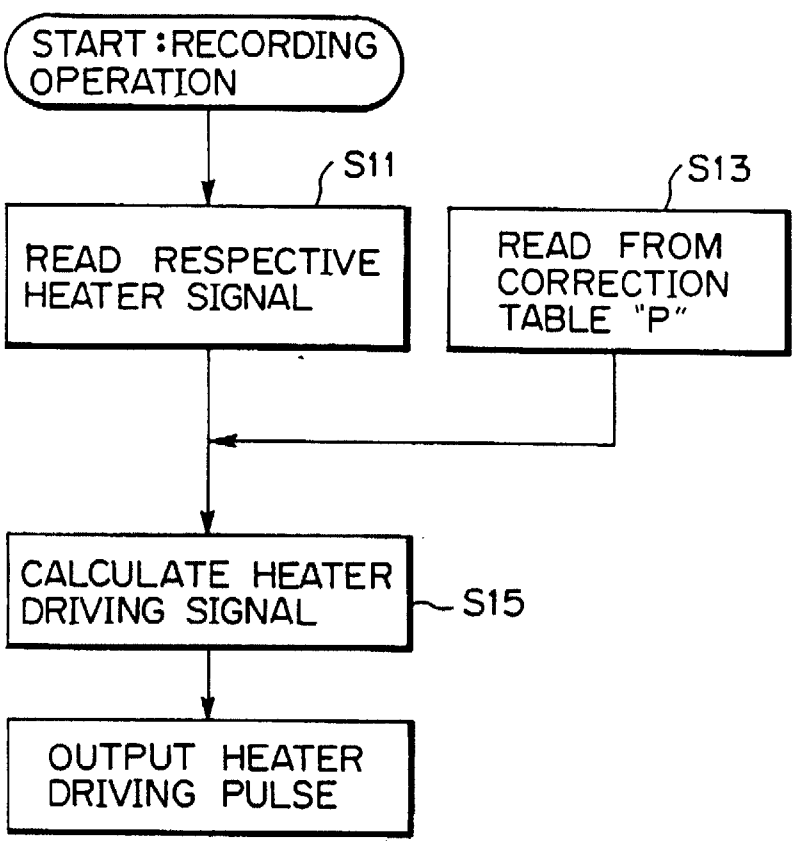
FIGS. 7A and 7B are flow charts for representing an example of an initial shading correcting sequence.
Figure 7A:
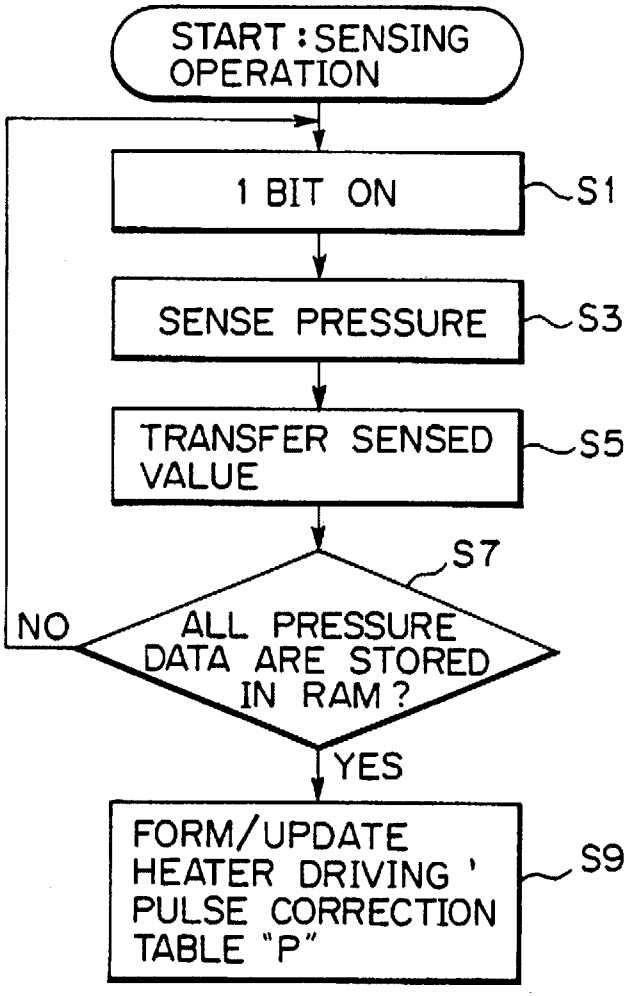

FIG. 7A is a flow chart for explaining a sequential operation to acquire a correction value.

Figure 8:
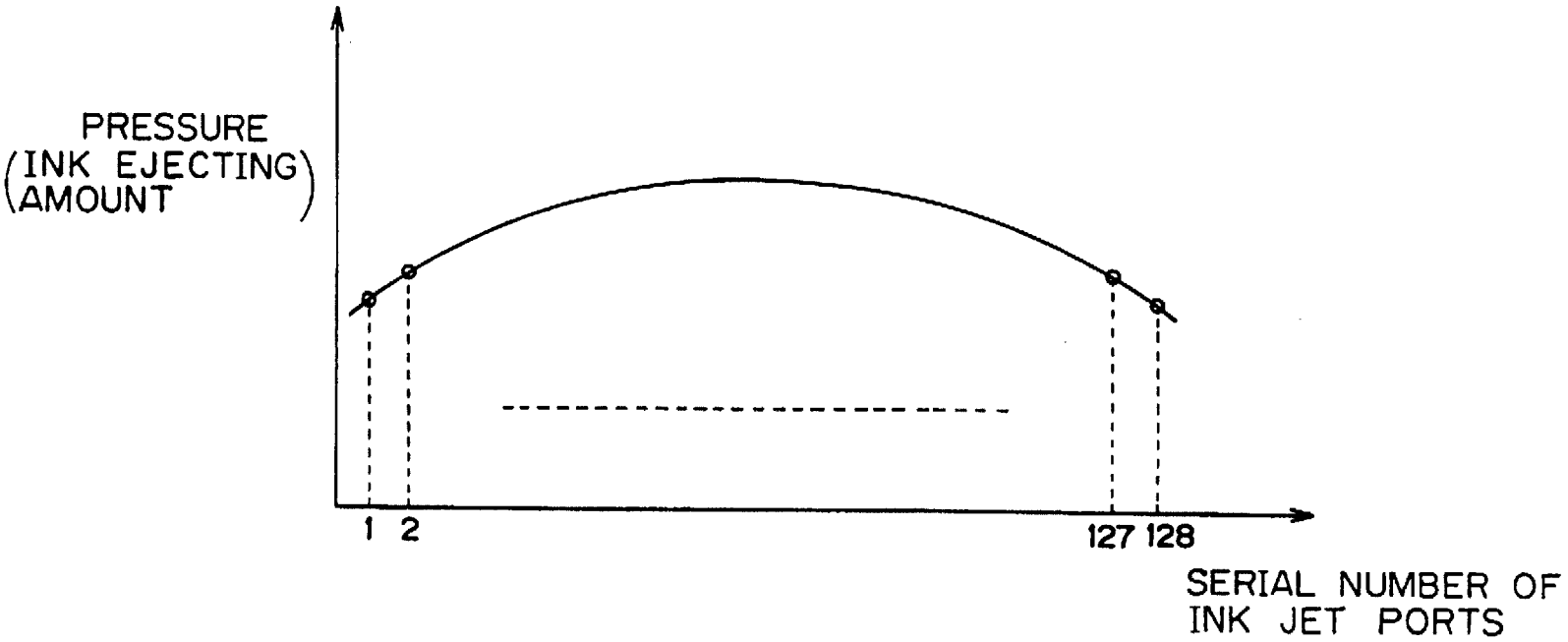
FIG. 8 is an explanatory diagram for representing unevenness in ink ejecting amounts caused by unevenness bubbling pressure.

First, a signal is supplied to the first heater 19 to produce bubble (step S1). This signal corresponds to a pulse having such a pulse width by which ink is not ejected. Under this condition, pressure data sensed by the pressure sensor 49 is stored as data about the first heater into, for instance, a RAM within the main control unit 60 (steps S3 and S5). Similarly, the signals are sequentially applied to the second heater up to the n-th heater, so that 128 sets of pressure data are stored in the RAM (step S7). Assuming now that such a data group is obtained as shown in FIG. 8, such a correction table is formed, or updated in a manner that, for instance, the maximum pressure value of one liquid path is compared with the pressure values of other liquid paths, and such pulses having pulse widths for correcting these pressure differences are employed as the pulses used to the respective liquid paths.

Then, during the recording operation, as illustrated in FIG. 7B, the heater driving signals are calculated with respect to the signals applied to the respective heaters, while referring to the correction table (steps S11 and S13). Based on the calculated values, the respective heaters are driven (step S15), so that unevenness in the ink ejecting amounts of these liquid paths is reduced, and thus the image without any initial shading is outputted.

It should be noted that as the factor of such unevenness in the ink ejecting amounts, it involves not only the above-described unevenness in bubble pressure, but also unevenness in the diameters of the liquid paths and the ink ejecting ports. As a consequence, the data about the diameter unevenness in this fluid path and ink jetting port are stored in, for instance, either the main control unit 60, or the ROM integrally formed in the printing head, and then the correction is performed in conjunction with the above-explained unevenness data about the bubble pressure, whereby unevenness in the ink ejecting amounts is effectively suppressed.

As previously described, it is possible to correct the initial shading that occurred in the ink ejecting amounts of the liquid paths. Furthermore, the above-described sequential operation is carried out at the proper timing, so that the correction table is updated and the time-lapse shading is corrected based on this updated correction table.

It should be understood that although the width of the ink ejecting pulse is varied in the above-described embodiment, the compensating method according to the present invention is not limited thereto, may be substituted by other methods such that the amount of ejecting pulses may be changed, or the pulse voltage may be varied. Furthermore, the pressure sensor is not required to be positioned within the liquid chamber, but may be located within a liquid path from the ink tank to the printing head. Also, the function of the pressure sensor may be achieved by sensing either pressure, or a variation in the pressure.

It could be recognized by the Applicants that the fluctuation in the foaming (bubble) pressure was corrected and recorded in accordance with the above-described sequential operations by employing the recording apparatus to which the compensating method of this embodiment has been applied, and when the same image patterns were outputted as in the conventional recording apparatus, better printed images with considerably reducing the ink density non-uniformity or shading could be produced.

On the other hand, there are some risks that the printing duty ratio would cause the temperatures of the heaters to be fluctuated, so that the ink ejection amounts during the recording operation could not be made constant.

Thus, both the correction value detected by the pressure sensor, and the data detected by the temperature sensor and thereafter transferred to the CCD elements are processed to obtain a new correction value. As a result, the initial unevenness is added to such dynamic ink-ejecting unevenness for the respective liquid paths, which is measured from the temperature distribution while the printing operation is actually performed, resulting in correction values for the respective liquid paths. Accordingly, the respective bit corrections can be perfectly performed.

Figure 9:
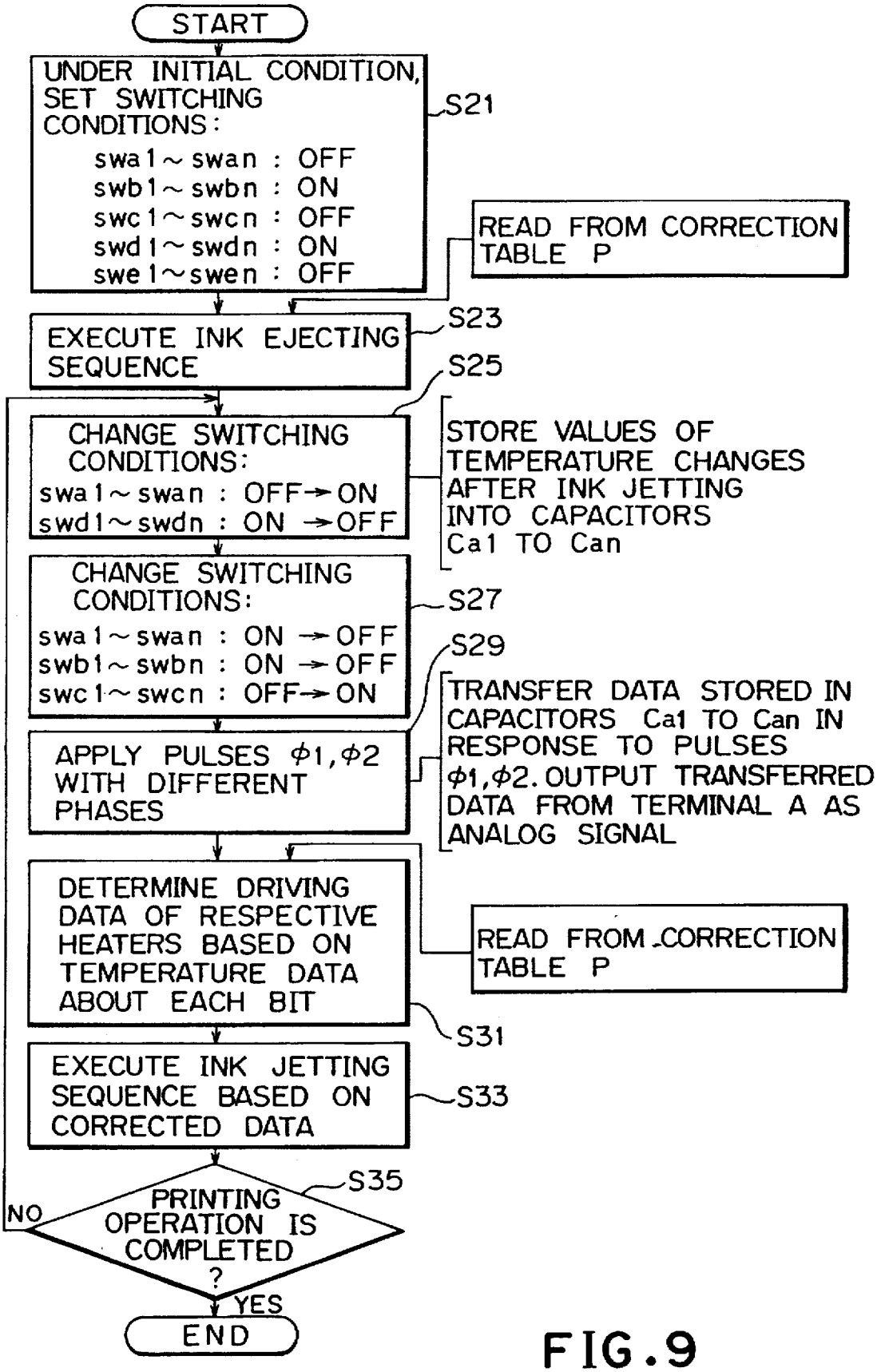
FIG. 9 is a flow chart for indicating an example of a sequence for correcting initial shading, temperature-increasing shading, and time-lapse shading.

FIG. 9 is a flow chart for explaining an example of process operation for the above-described bit correction control. A first step S21 of this process operation indicates a process operation executed under initial condition. As previously described with reference to FIG. 5, the switches swa1 to swan, swc1 to swcn, and swe1 to swen are turned OFF, whereas the switches swb1 to swbn and swd1 to swdn are turned ON. Next, at a step S23, the printing operation, namely the ink ejecting sequential operation is carried out, while referring to the table "P" used to correct the foaming pressure unevenness, which has been formed or updated by the process sequential operation defined in the flow chart of FIG. 7A.

Subsequently, at a step S25, the switches swa1 to swan are turned ON, and the switches swd1 to swdn are turned OFF. As a result, the electron charges whose amount corresponds to the temperature just after the ink ejecting operation are stored into the capacitors Ca1 to Can. Then, at a step S27, the switches swa1 to swan and swd1 to swdn are turned OFF, whereas the switches swc1 to swcn are turned ON. At the subsequent step S29, the pulses ø1 and ø2 having the different phases from each other are applied so as to alternately turn ON/OFF the switches swd1 to swdn and the switches swe1 to swen. As a result, the data stored in the capacitors Ca1 to Can are sequentially shifted to the respective capacitors Cb1 to Cbn and the respective capacitors Ca2 to Can. On the other hand, the respective data are successively transferred from the terminal "A".

Thereafter, at a step S31, a determination is made of optimum heater driving data based on the temperature data for each bit (heating element) while considering the correction data stored in the correction table "P". It should be noted that this drive data determined at this step S31 may be defined as follows. That is, for instance, the pulse width of this driving pulse signal may be varied. Further, in the apparatus in which the preheat pulse and the main heat pulse are supplied the width of the preheat pulse and/or the main heat pulse or the interval therebetween may be varied.

Furthermore, at a step S33, the ink ejecting sequential operation is executed in response to the above-described heater driving data. Then, at a step S35, a check is done as to whether or not a preselected amount (e.g., 1 sheet) of printing operation is accomplished. If not yet completed, then the sequential operations defined after the step S25 are repeatedly executed.

In accordance with the above-described control process operation, the initial shading is corrected based on the pressure detected value from the pressure sensor. Both of the temperature increasing shading and the time-lapse shading are corrected in accordance with the amounts of electron charges stored in the CCD elements, so that such a better image without any ink density non-uniformity or shading is obtained.

[SECOND EMBODIMENT]

As previously explained in connection with the first embodiment, the driving signals for the printing elements (heating elements) have been corrected based upon the information such as temperature information detected by the printing element information detecting apparatus. As the circuit for driving the respective printing elements in response to this correction value, there are possibly provided driving circuits including a digital shift register, or an analog shift register in which a CCD element array is arranged similar to the above-described detecting apparatus. In this case, if the CCD element for storing or transferring the temperature data is commonly used to transfer or store the drive data, namely the printing element information detecting circuit and the head driving circuit are commonly utilized, then the entire printing apparatus could be made more compact.

Figure 10:
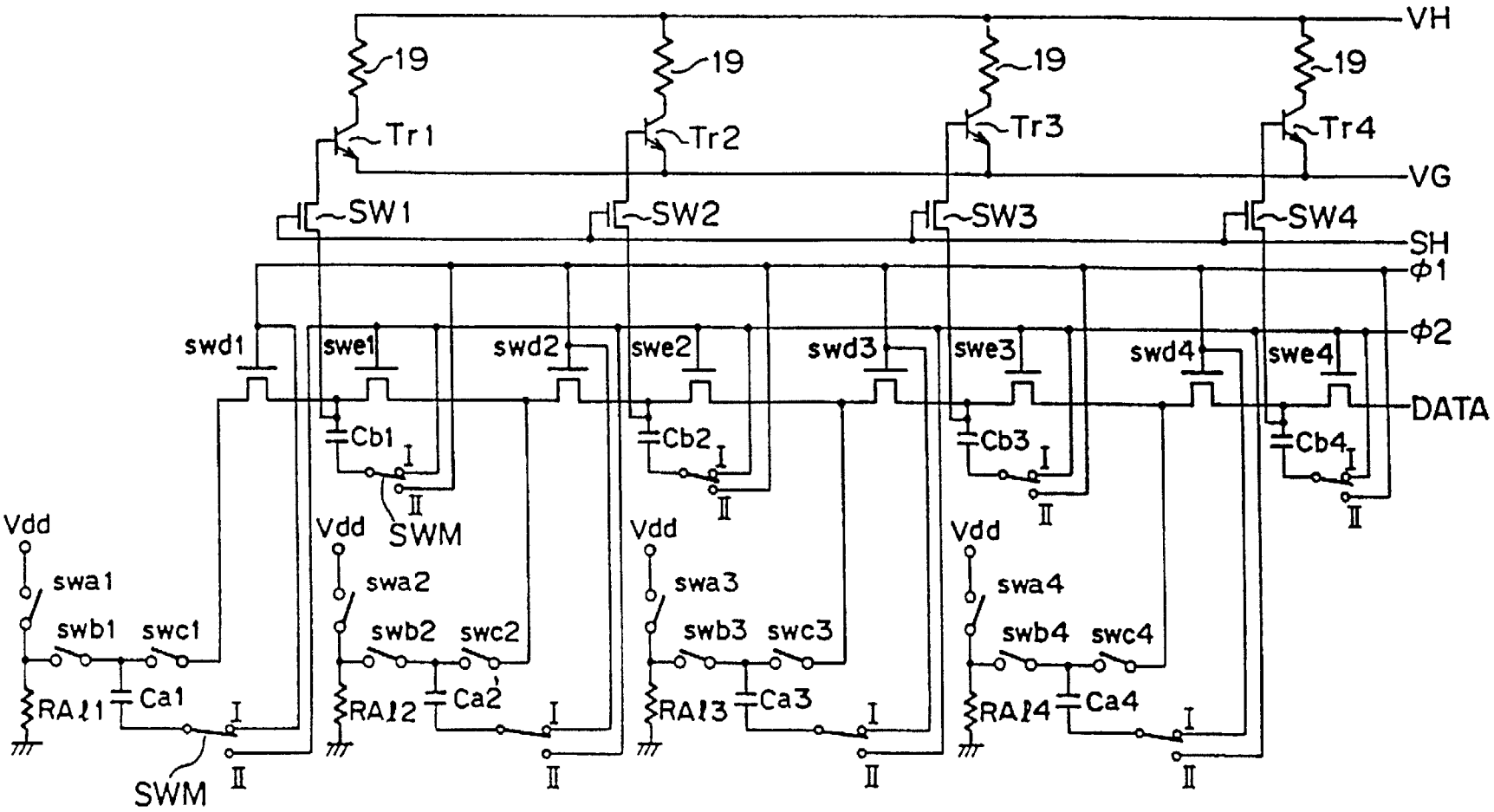
FIG. 10 is a circuit diagram of a combination between a temperature-increasing shading detecting circuit and a printing element driving circuit, according to an embodiment of the present invention.

In FIG. 10, there is shown such a circuit arrangement for the printing element information detecting circuit combined with the head driving circuit. As apparent from the above-described circuit arrangement indicated in FIG. 5, the major circuit arrangement thereof is substantially employed in this circuit arrangement of FIG. 10.

In FIG. 10, symbol SWM indicates a plurality of switches each of which is provided at the other terminal opposite to the terminal connected to the switches SW1 to SWn, swd1 to swdn and swe1 to swen for each of the capacitors Cb1 to Cbn, and at the other terminal opposite to the terminal connected the switches swb1 to swbn and swc1 to swcn for each of the capacitors Ca1 to Can. These switches SWM are commonly switched to either I-side or II-side by a control signal line (not shown). In other words, while the temperature data is stored or transferred, these switches SWM are changed into the I-side, so that the capacitors Ca1 to Can are connected to the line of the signal ø1, and the capacitors Cb1 to Cbn are connected to the line of the signal ø2. On the other hand, when the driving data is transferred or stored, the switches SWM are changed into the II-side, so that the capacitors Ca1 to Can are connected to the line of the signal ø2, and the capacitors Cb1 to Cbn are connected to the line of the signal ø1. As a consequence, when the temperature data is stored or transferred, the switches SWM are changed into the I-side, and the remaining switches may be controlled in a similar manner to that of the first embodiment.

One end of the heating element (#1, #2, . . . ) for generating thermal energy used to produce bubble within the liquid path 16 is connected to the head driving power source 80, and the other end of this heating element is connected to a collector terminal of an NPN type transistor (Tr1, Tr2, . . . ). Symbols SW1, SW2, . . . are switches interposed between bases of the NPN transistors (Tr1, Tr2, . . . ) and analog shift registers, respectively. These switches SW1, SW2, . . . are switched in response to a heating element driving signal SH so as to connect the heating elements and one ends of these capacitors Cb1 to Cbn. In connection with this switching connection, the NPN transistors Tr1, Tr2, . . . are turned ON for a time period corresponding to the electron charge stored amounts of the capacitors Cb1 to Cbn, whereby the heating elements #1, #2, . . . are driven. In this circuit of FIG. 10, symbol VG denotes a ground line commonly connected to emitter terminals of the NPN transistors Tr1, Tr2, . . .

Figure 11A:
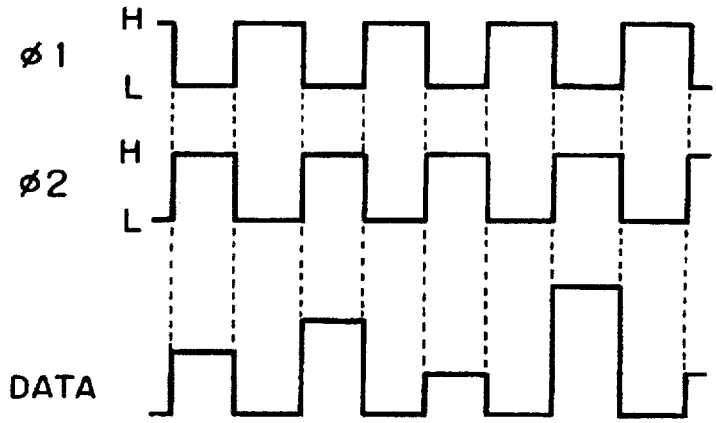
FIGS. 11A and 11B show timing charts for explaining operations of the detecting circuit and the driving circuit indicated in FIG. 10.

On the other hand, when the driving data is transferred prior to the execution of the ink ejected sequence, the switches SWM are switched to the II-side, so that the transfer operation of the driving data is carried out as follows:

As shown in FIG. 11A, analog data for determining the width of the driving pulse for each bit is transferred in synchronism with the transfer operations of the clock pulses ø1 and ø2 during the data transfer operation. This analog data corresponds to such a data to be charged into the respective capacitors Cb1 to Cbn with respect to each bit. As a result, the respective analog data are aligned in the capacitors Cb1 to Cbn when the data transfer operation is completed.

Figure 11B:
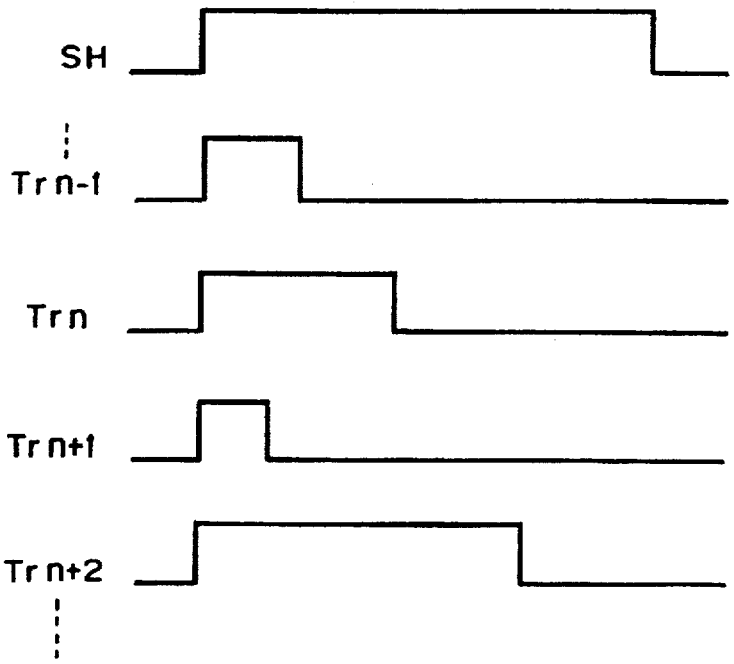

Next, as shown in FIG. 11B, the supply of the clock signals ø1 and ø2 are stopped when the heating elements are driven. Then, when the drive signal SH is brought into the ON-state, the switches SW1, SW2, . . . are closed. During the ON-period, in response to the electron charges charged into the respective capacitors Cb1, Cb2, . . . namely the electron charges stored therein in accordance with the widths of the driving pulses, the respective heaters #1, #2, . . . are energized to eject ink. It should be understood that after the driving signal is turned ON and then the switches SW1, SW2, . . . are closed, this ON-state is maintained for a predetermined time period. Thus, the conducting times of the respective transistors Tr1, Tr2, . . . are varied in response to the amounts of electron charges stored into the CCD elements. In other words, the heating elements #1, #2, . . . are driven under conditions suitable for the respective dots.

Figure 12A:
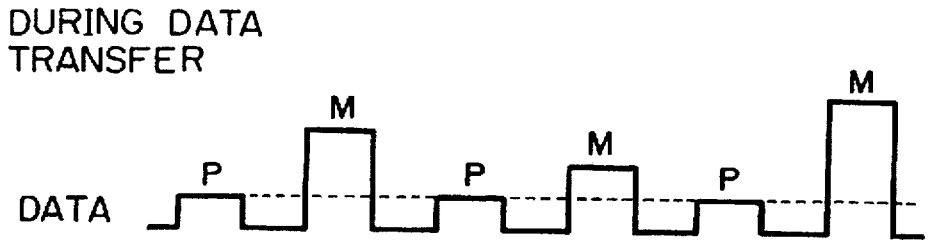
FIGS. 12A and 12B are timing charts for explaining operations of the circuits according to another embodiment of the present invention.

Alternatively, the above-described circuit of FIG. 10 may be modified as follows. That is, capacitors are properly interposed among the above-described capacitors, which are driven in response to the proper clockpulses. As shown in FIG. 12A, during the data transfer operation, such analog data are alternately transferred in synchronism with these clock pulses, by which the width of the driving pre-pulse and the width of the driving main pulse are determined. These analog data correspond to the data which should be charged into the capacitors for the respective bits. When the data transfer operation is accomplished, the pre-pulse data P and the main pulse data M are aligned in the corresponding capacitors Cb1, Cb2, . . . and Ca1, Ca2, . . . Further, although the pre-pulse data are made constant in the example shown in FIG. 12A, these pre-pulse data may be made different from each other in accordance with the characteristics of the heating elements.

Figure 12B:
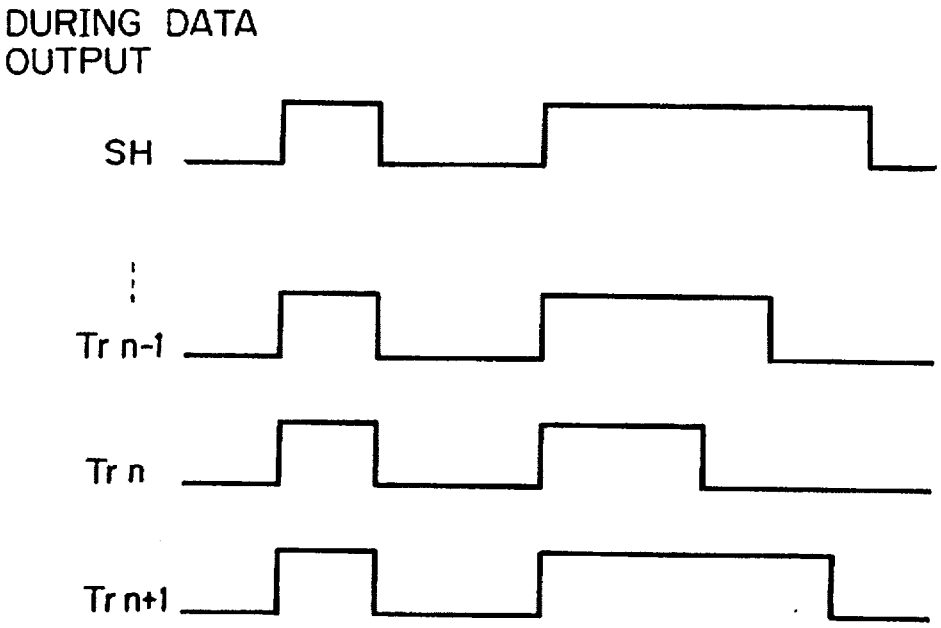

After the data have been transferred, the supply of the clock pulses are stopped. When the drive signal SH is brought into the ON-state as shown in FIG. 12B, the switches SW1, SW2, . . . are closed. During the ON-time period, the respective heaters #1, #2, . . . are energized in response to the charges stored in the respective capacitors Cb1, Cb2, . . . in correspondence with the widths of the pre-pulses.

Subsequently, the clock pulses are properly produced to transfer the analog data to the capacitors Ca1, Ca2, . . . and Cb1, Cb2, . . . When the drive signal SH is brought into the ON-state, as illustrated in FIG. 12B, the switches SW1, SW2, . . . are closed. Then, the transistors Tr1, Tr2, . . . are caused to be conductive during such a time period corresponding to the amount of charges stored into the capacitors Cb1, Cb2, . . . which correspond to the widths of the ink jetting data (main pulse), so that the heaters #1, #2, . . . are energized to eject ink.

Then, in accordance with this second embodiment, as shown in FIG. 12B, after the signal SH and the switches SW1, SW2, . . . are turned ON when the pre-pulse is outputted and the main pulse is outputted, the ON-states are maintained for a predetermined time period. Accordingly, the conducting periods of the respective transistors Tr1, Tr2, . . . are varied in accordance with the amount of charges stored in the CCD elements. In other words, the PWM modulation can be performed with respect to these dots corresponding to the heating elements #1, #2, . . .

Instead of the above-explained PWM modulation, the ink ejecting timing of the respective pixels may be subdivided into a plurality of ink ejecting timings (for instance "8"), and also the ON-time per one heating operation is fixed. Such data defined by multiplying the ink ejecting number by the ON-time with respect to the respective pixels Of the CCD element, whereby the switches SW1, SW2, . . . are turned ON/OFF plural times equal to the subdividing number. As a consequence, the ink ejecting operations are carried out with regard to a single pixel by 0–8 times in accordance with the amount of charges stored in the CCD elements. That is to say, it is possible to transfer the data about the plural ink ejecting operations for a single pixel by transferring the analog data only one time.

Moreover, according to another modification of this embodiment, a plurality of CCD elements are additionally employed with respect to each dot, so that the number of pre-pulses may be controlled.

Although both the CCD circuit and the heaters are mounted on the same substrate in the above-explained embodiment, this CCD circuit may be mounted on another substrate.

[THIRD EMBODIMENT]

In a printing apparatus to which the above-described CCD circuit is applied, a thermal adverse influence given to the CCD circuit should be highly considered. As the thermal adverse influence, the following causes may be conceived. That is, the driving circuit itself radiates thermal energy during the image forming operation. Further, in such a head as previously described, the heating elements generate thermal energy by operating because the thermal energy is utilized so as to supply the recording agent to a recording medium.

For instance, in such a printing head driving apparatus to which the CCD circuit is applied, when thermal energy is given to the CCD circuit portion, the dark current would become large due to this thermal adverse influence, which could not be neglected. As a result, unwanted electric charges different from those of the original signals are produced. Subsequently, if the true image data signals are entered into the CCD circuit, both the electric charges caused by the dark current and the electron charges caused by the true image signal are accumulated in the CCD circuit. Then, when these electric charges are discharged, such a different signal from the original image signal is transferred to the printing element, so that the image is erroneously formed.

Furthermore, in such a printing element information detecting apparatus to which the CCD circuit is applied, when the thermal adverse influence produced before the true detecting timing remains in the CCD circuit, a correct detection cannot be achieved.

Therefore, a third embodiment (will be described below) intends to solve the above-described thermal problems. It should be noted that although a printing head driving apparatus to which the CCD circuit has been applied is so arranged as to eliminate the adverse influence caused by the dark current, this featured circuit arrangement may be similarly, effectively applied to such a printing element information detecting apparatus equipped with the CCD circuit.

Figure 13:
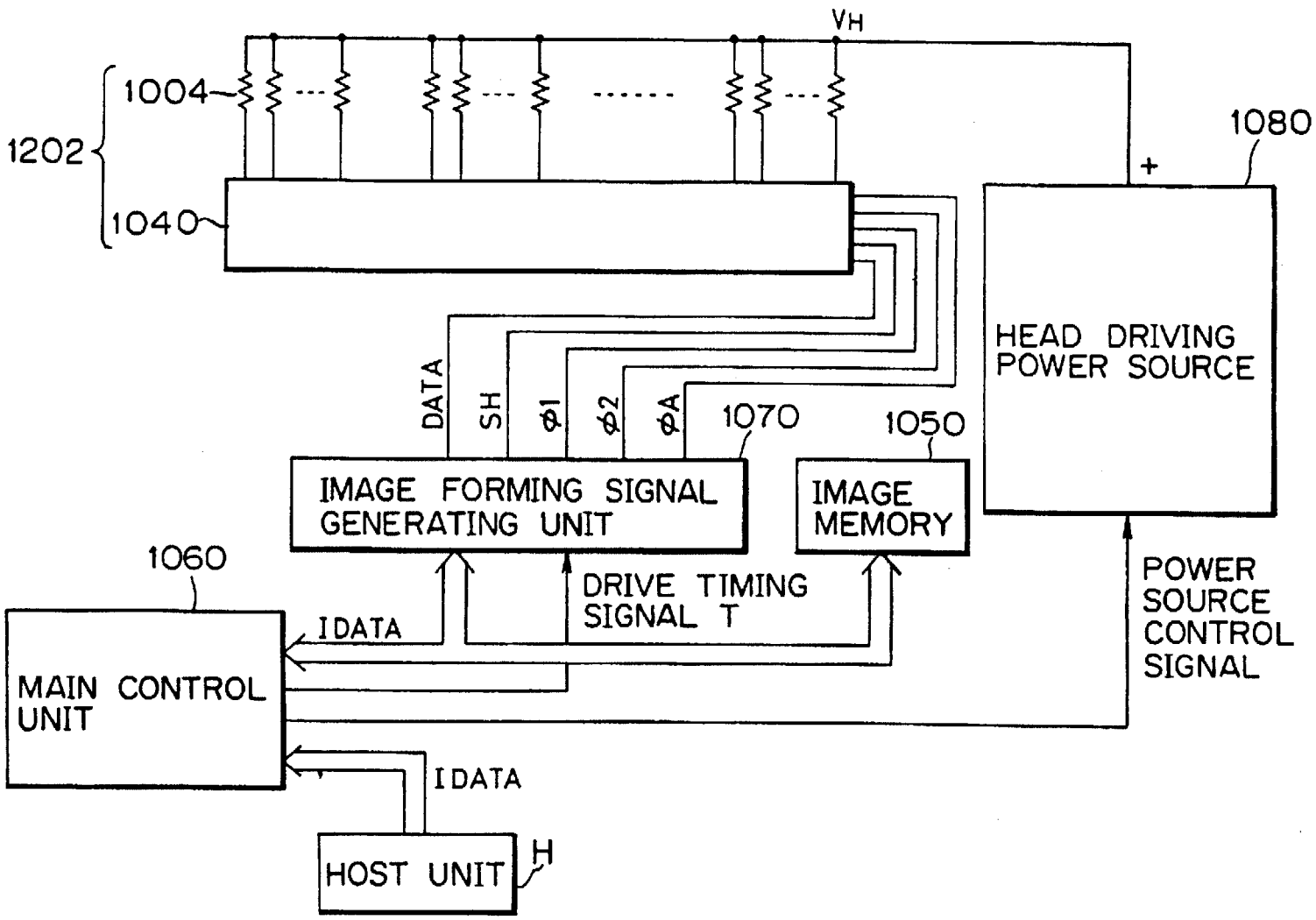
FIG. 13 is a schematic block diagram for showing a control system of a printing head, according to a further embodiment of the present invention.

In FIG. 13, there is shown a circuit arrangement of a recording head control system according to the third embodiment of the present invention. Reference numeral 1202 indicates a recording head containing a group of heating register elements (heaters) 1004 and a driving circuit 1040 for driving this heating register element group 1004, which are fabricated on a substrate similar to the above-described substrate 1 of FIG. 1. Reference numeral 1050 indicates an image memory for storing therein image data "IDATA" which is directly supplied from a host unit "H" functioning as an image data supplying source, or supplied via a main control unit 1060 of the recording apparatus. Reference numeral 1070 is an image forming signal generating unit. In response to a drive timing signal "T" derived from the main control unit 1060, this image forming signal generating unit 1070 reads out the image data stored in the image memory 1050, and generates a data signal DATA having such an analog amount corresponding to the driving energy which is defined to the respective heating elements; clock signals ø1 and ø2 used to determine the transfer timings of this data signal; a signal SH for driving the heating element group; and furthermore a signal øA for causing the CCD elements of the head drive circuit 40 to be discharged. Reference numeral 1080 shows a head driving power source for applying a preselected voltage to a common electrode VH during the recording operation.

On the other hand, there are some cases in which a printing element driving operation has different conditions set to the respective printing elements, for instance, when gradation or half-tone recording is available, or when the corrections of the driving conditions (will be referred to "bit correction" hereinafter) are required with regard to the printing elements.

In general, in the ink jet type recording apparatus, thermal energy produced by supplying power to the electric thermal converting member is given to the ink, thereby instantaneously producing thermal sublimation, and the ink is ejected from the ink jet ports by means of the bubble pressure, so that the desired image is formed. Since this ink jet type recording apparatus has such advantages that the recording speed as well as the recording density are high, and also the color image forming can be easily achieved, this type of recording apparatus is widely utilized recently. Among all thermal energy generated from the electro-thermal converting member, a portion of this thermal energy other than the thermal energy converted into the kinetic energy of the ejected ink droplets, and the thermal energy brought away by the ejected ink, is left within the printing head, which may increase the temperature of this printing head.

On the other hand, it is known that coefficient of viscosity of the ink is varied in response to the temperature of the printing head, especially the temperatures around the electro-thermal converting member, and also the amount of ejected ink is varied even by receiving the same driving signal at the electric thermal converting member, a temperature distribution would be produced in the printing head, depending upon using frequencies of the plural electric thermal converting members and furthermore the using conditions of the recording apparatus. As a result, ink density (concentration) of the formed image would be fluctuated, and therefore, reproducibility of the formed image would be deteriorated. Furthermore, if there is unevenness in the dimensions of the ink ejected ports of the printing head, then the amount of ejected ink would own a distribution within the printing head. Also, under such a condition, ink density shading would be produced in the formed image.

To solve such problems, the compensating technique has been proposed that the energy of the driving signals applied to the respective thermal converting members, for instance, either the width or the voltage of the pulse signal is varied so as to make the ink ejecting amount constant and uniform. Another compensating technique has been proposed that before the pulse signal ("main heat pulse") capable of producing bubble in the ink is applied, another pulse signal ("preheat pulse") capable of not producing bubble in the ink is properly applied to preheat this ink, and thus the ink ejecting amount is made constant and uniform regardless of the temperature distribution and the dimensional unevenness in the ink ejecting ports. Furthermore, a further conventional compensating technique has been proposed that when the above-described compensating operation is carried out, both the width of the preheat pulse and the time interval between the main heat pulse and the preheat pulse are properly changed with respect to each of the electro-thermal converting members.

Conventionally, other than that the driving conditions different from each other can be set with respect to each printing element of the electro-thermal converting members, there are provided the digital shift registers arranged in such a manner that a plurality of circuit elements correspond to one printing element.

Also, in the conventional ink jet type recording apparatus capable of realizing the gradation recording, plural droplets of ink can be ejected with regard to one pixel, and the number of ink droplets to be ejected with respect to each of these electro-thermal converting members may be set. This is achieved by that when the maximum number of ink droplets to be ejected is selected to be, for instance, 8, namely when the quantity of ink dots capable of achieving optimum pixel concentration (density) is 8, such data is determined as to whether or not the ink ejecting drive is executed at each of the eight ink ejecting timings, and then this determined data is set to all of the electric thermal converting members. Even in such a case, the digital shift register having a plurality of storage elements is provided with respect to each of the electric thermal converting elements, and then the above-described data are transferred to this digital shift register to align the image data.

However, in such a conventional ink jet apparatus that the image data are aligned by way of the digital shift register, when it is possible to drive the printing elements by setting the different conditions to the respective printing elements, such a digital shift register having a plurality of storage elements with respect to each of the printing elements should be employed.

To solve this difficulty, such a printing head driving circuit 1040 according to this embodiment is constructed that a shift register having CCD elements is included, and electric charges are stored into each of the CCD elements, the amount of which corresponds to drive energy of the corresponding printing elements.

In other words, according to this third embodiment, the above-described conventional problems such that the complex and costly circuit is necessarily arranged by employing the digital shift register could be solved in the following manner. The image data, gradation data, or driving condition correction data is charged as electric charges within the CCD circuit, and then is discharged, so that the discharged electric charges are supplied to the respective electric thermal converting members.

Figure 14:
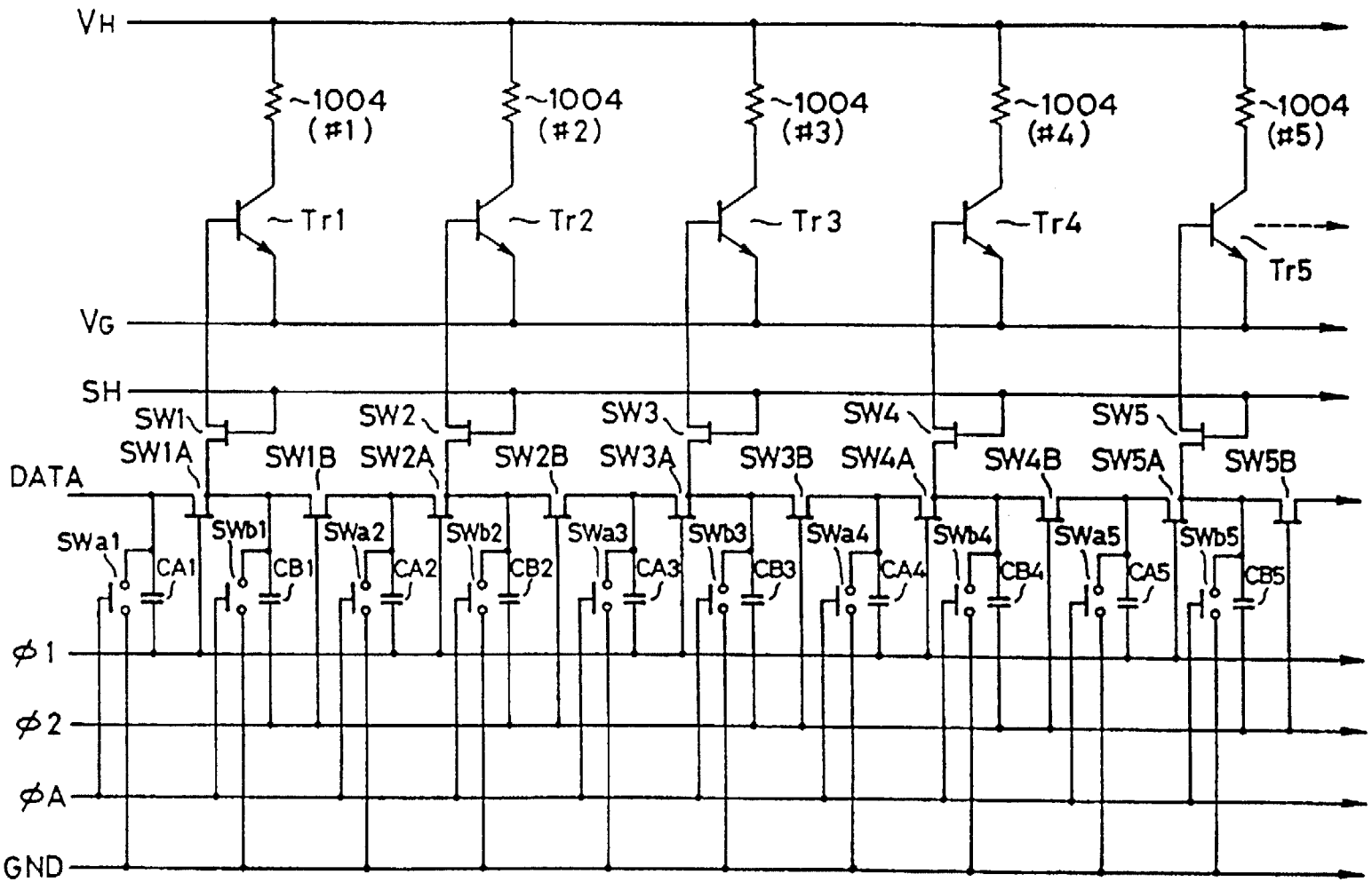
FIG. 14 is a circuit diagram of a printing head driving apparatus, according to an embodiment of the present invention, applicable to the control system of FIG. 13.

FIG. 14 shows a circuit arrangement of the head driving circuit 1040. One end of the heating element 1004 (#1, #2, . . . ) for generating thermal energy used to produce bubble within the fluid path is connected to the head driving power source 1080, and the other end of this heating element is connected to a collector terminal of an NPN type transistor (Tr1, Tr2, . . . ). Symbols SW1, SW2, . . . are switches interposed between bases of the NPN transistors (Tr1, Tr2, . . . ) and analog shift registers, respectively. These switches SW1, SW2, are switched in response to a heating element driving signal SH so as to connect the heating elements and a CCD element of the analog shift register. In connection with this switching connection, the NPN transistors Tr1, Tr2, . . . are turned ON for a time period corresponding to the electron charge stored amounts of the CCD element, whereby the heating elements #1, #2, . . . are driven. In this circuit of FIG. 14, symbol VG denotes a ground line commonly connected to emitter terminals of the NPN transistors Tr1, Tr2 . . .

The combinations among the capacitors CA1, CA2, . . . and the switches SW1, SW2, and the combinations among the capacitors CB1, CB2, . . . and the switches SW1, SW2, . . . are the basic structure of the CCD element except that the photodiode is provided. In this embodiment, two sets of such a combination between a switch and a capacitor for example, a combination between the switch SW1A and the capacitor for example, a combination between the switch SW1A and the capacitor CA1 and a combination between the switch SW1A and the capacitor (B1) are employed for a single heating element (for example, #1), so that the analog shift register is constituted. The capacitors CA1, CA2, . . . are connected between the line of the transfer clock and the line of the data signal DATA. The capacitors CB1, CB2, . . . are connected between the line of the transfer clock ø2 and the line of the data signal DATA. Both of the switches SW1A, SW2A, . . . and the switches SW1B, SW2B, . . . are arranged on the data line. The switches SW1A, SW2A . . . and the switches SW1B, SW2B . . . are operable in response to the transfer clocks ø1 and ø2, respectively, so that the data are transferred among the capacitors CA1, CB1, CA2, CB2, . . . and also the signals are supplied from the capacitors CB1, CB2, . . . to the corresponding transistors Tr1, Tr2, . . . In addition, the switches SWa1, SWa2, . . . and the switches SWb1, SWb2, are provided in correspondence with the capacitors CA1, CA2, . . . and the capacitors CB1, CB2, . . . These switches are closed in response to a signal øA at proper timing, so that these switches are connected to the ground (GND) line to discharge the stored electric charges.

Figure 15A:
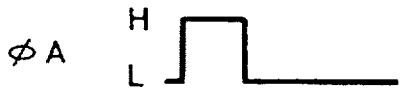
FIGS. 15A to 15C are timing charts for describing operations of the printing head driving apparatus shown in FIG. 14.
Figure 15B:
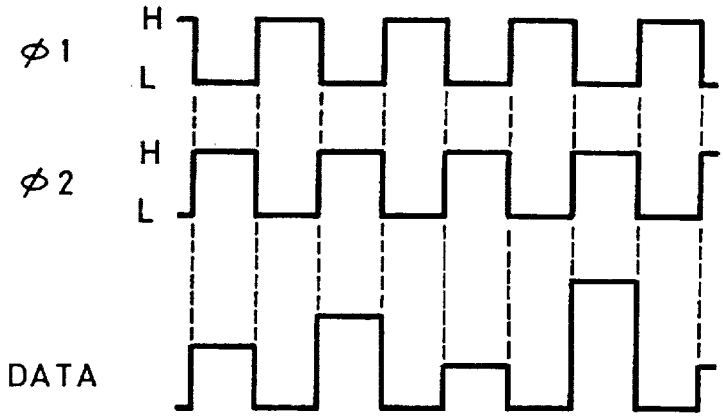
Figure 15C:
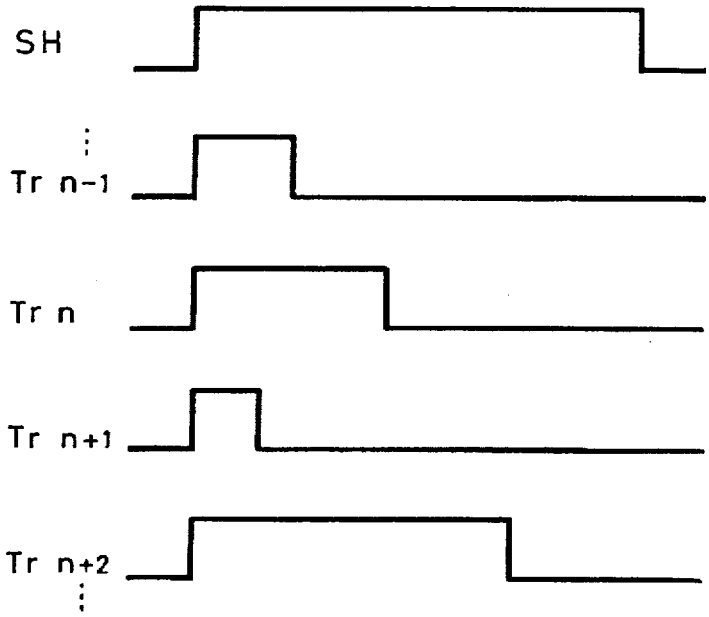

FIGS. 15A, 15B and 15C are timing charts for showing signals appearing at various circuit portions of the analog shift register indicated in FIG. 14. FIG. 15A is an operation timing chart of the signals before data transfer, FIG. 15B is an operation timing chart of the signals during data transfer, and FIG. 15C is an operation timing chart of the signals when the data are outputted.

In this embodiment, as represented in FIG. 15A, prior to the data transfer operation, the signal øA of FIG. 14 is applied during a proper time period so as to turn ON the switches SWa1, SWb1, SWa2, SWb2, . . . , whereby the electric charges stored in the respective CCD elements are discharged. That is, in such a type of ink jet recording apparatus for utilizing the thermal energy to the printing operation, the temperature of the substrate is increased to high values, so that the electric charges produced by the dark currents of the CCD elements would be stored, and also uneven charge storage conditions would occur due to the temperature distribution on the substrate. As a result, these unnecessary charges would be superimposed with the charges caused by the true or original data, so that unwanted images would be formed. To avoid such a problem, in the ink jet type recording apparatus of this embodiment, the switches SWa1, SWb1, SWa2, SWb2, . . . are provided in connection with the respective CCD elements. Furthermore, prior to the data transfer, as illustrated in FIG. 15A, these switches are turned ON so as to discharge the unnecessary electron charges caused by the dark current. As a consequence, only the electric charges corresponding to the original (true) image data can be stored into the CCD elements, and subsequently, the stable ink jet amount control operation is carried out. Thus, the image data with higher image quality can be printed out.

As indicated in FIG. 15B, when the image data is transferred, analog data is transferred in synchronism with the transfer clocks ø1 and ø2, by which the drive pulse widths are determined with respect to each of the bits. This analog data corresponds to such data which should be charged into the capacitors for the respective charges. As a consequence, when the data transfer operation is completed, the respective data are aligned in the capacitors CB1, CB2, . . .

Subsequently, the supply of the transfer clocks ø1 and ø2 are stopped, and then when the driving signal SH is brought into ON-state, as shown in FIG. 15C, the switches SW1, SW2, . . . are closed. During the ON-time period, the electric charges stored in the respective capacitors CB1, CB2, . . . namely the electric charges stored therein in accordance with the above-described drive pulse widths may cause the respective heaters #1, #2, . . . to be energized, so that the ink droplets are ejected. It should be noted that the ON-state of the driving signal SH and the switches SW1, SW2, . . . are maintained for a preselected time period after the driving pulse is outputted. Accordingly, the conducting times of these transistors Tr1, Tr2, . . . which correspond to the amounts of electric charges stored in the CCD elements, are varied. In other words, the ink ejecting operation is achieved under such a condition suitable for the respective dots corresponding to the heating elements #1, #2, . . .

Incidentally, similar to the above-described operations with respect to the second embodiment, in the circuit shown in FIG. 14, capacitors may be properly interposed among the above-described capacitors, which are driven in response to the proper clock pulses. That is, as shown in FIG. 12A, during the data transfer operation, such analog data are alternately transferred in synchronism with these clock pulses, by which the width of the driving pre-pulse and the width of the driving main pulse are determined. These analog data correspond to the data which should be charged into the capacitors for the respective bits. When the data transfer operation is accomplished, the pre-pulse data P and the main pulse data M are aligned in the corresponding capacitors CB1, CB2, . . . and CA1, CA2, . . . Further, these pre-pulse data P may be made different from each other in accordance with the characteristics of the heating elements.

After the data have been transferred, the supply of the clock pulses are stopped. When the drive signal SH is brought into the ON-state as shown in FIG. 12B, the switches SW1, SW2, . . . are closed. During the ON-time period, the respective heaters #1, #2, . . . are energized in response to the charges stored in the respective capacitors CB1, CB2, in correspondence with the widths of the pre-pulses.

Subsequently, the clock pulses are properly produced to transfer the analog data to the capacitors CA1, CA2, . . . and CB1, CB2, . . . When the drive signal SH is brought into the ON-state, as explained in FIG. 12B, the switches SW1, SW2, . . . are closed. Then, the transistors Tr1, Tr2, . . . are caused to be conductive during such a time period corresponding to the amount of charges stored into the capacitors CB1, CB2, . . . which correspond to the widths of the ink ejecting data (main pulse), so that the heaters #1, #2, . . . are energized to jet droplets of ink.

Also, in this third embodiment, prior to the data transfer operation as represented in FIG. 12A, the signal øA of FIG. 14 is applied for a proper time period to cause the switches SWa1, SWb1, SWa2, SWb2, . . . and other switches to be turned ON, so that the electron charges stored in the CCD elements are discharged. As a result, only the electric charges caused by the original (true) data (in this case, data for defining preheat pulse and main heat pulse) are stored, and thereafter the stable ink ejecting amount controlling operation is carried out. Thus, the image data with the better image quality can be printed out.

Then, as already explained in FIG. 12B, after the signal SH and the switches SW1, SW2, . . . are turned ON when the preheat pulse is outputted and the main heat pulse is outputted, the ON-states are maintained for a predetermined time period. Accordingly, the conducting periods of the respective transistors Tr1, Tr2, . . . are varied in accordance with the amount of charges stored in the CCD elements. In other words, the PWM modulation can be performed with respect to these dots corresponding to the heating elements #1, #2, . . .

Instead of the above-explained PWM modulation, the ink ejecting timing of the respective pixels may be subdivided into a plurality of ink ejecting timings (for instance "8"), and also the ON-time per one heating operation is fixed. Such data defined by multiplying the ink ejecting number by the ON-time with respect to the respective pixels of the CCD element, whereby the switches SW1, SW2, . . . SW4 are turned ON/OFF plural times equal to the subdividing number. As a consequence, the ink ejecting operations are repetitively carried out with regard to a single pixel by 0–8 times in accordance with the amount of charges stored in the CCD elements. That is to say, it is possible to transfer the data about the plural ink ejecting operations for a single pixel by transferring the analog data only one time.

Moreover, according to another modification of this embodiment, a plurality of CCD elements are additionally employed with respect to each dot, so that the number of pre-pulse may be controlled.

In addition, the analog signals inputted into the circuit of FIG. 1 are properly processed based on the unevenness data of the respective bits (for instance, ink density data is acquired by way of test printing operation), whereby the correction data can be obtained. Based on this correction data, such a proper modulation is carried out, so that the ink ejecting fluctuation of the respective bits can be corrected.

Although both the CCD circuit and the heaters are mounted on the same substrate in the above-explained embodiment, this CCD circuit may be mounted on another substrate.

[FOURTH EMBODIMENT]

Figure 16:
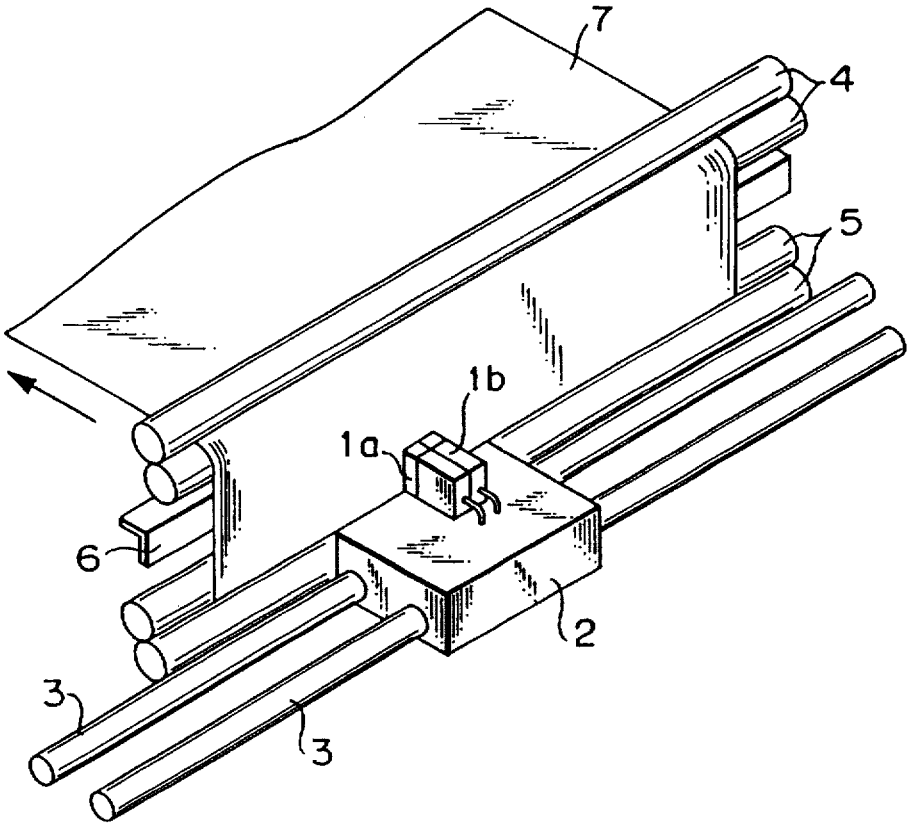
FIG. 16 is a perspective view for schematically representing an example of a printing system arranged by the printing head driving apparatus, the printing head, and the control systems thereof.

In accordance with a fourth embodiment of the present invention, a serial printer capable of recording an image in full color is constructed as illustrated in FIG. 16 with employment of the above-described recording head, driving circuit, and control systems thereof.

FIG. 16 is a schematic perspective view showing the main portion of the ink jet recording apparatus to which the present invention is applicable. In FIG. 16, the recording heads 1*a* and 1*b* respectively corresponding to different colors or densities are provided with 256 ink orifices in the direction of transfer of a recording paper R and in opposing to the recording paper R. Each of the heads 1*a* and 1*b* has the construction as shown in FIG. 1, 2 and 6.

A carriage 502 carries the recording heads 1*a* and 1*b*, and engages slidably with a pair of guide rails 503 extending in parallel with the recording face of the recording paper R. Therefore, the recording heads 1*a* and 1*b* can move along the guide rails 503. When the heads move, they eject the ink at the predetermined timing and make a record. After the movement, the recording paper R is transferred by the predetermined distance in the direction of arrow shown in FIG. 16. The heads 1*a* and 1*b* move again in the same way and make a record. By repeating such an operation, the recording paper R is recorded in order.

The recording paper R can be transferred by rotating a pair of transfer rollers 504 and 505 each disposed on one side of the recording paper face. A platen 506 is disposed on the back side of the recording face of the recording paper 507 in order to maintain a plane of the recording face.

It is possible to move the carriage by providing a belt (not shown) attached to the carriage and driving it by a motor (not shown). And it is possible to rotate the transfer rollers 504 and 505 by transmitting the rotation of a motor (not shown) to them.

[OTHER EMBODIMENT]

Figure 17:
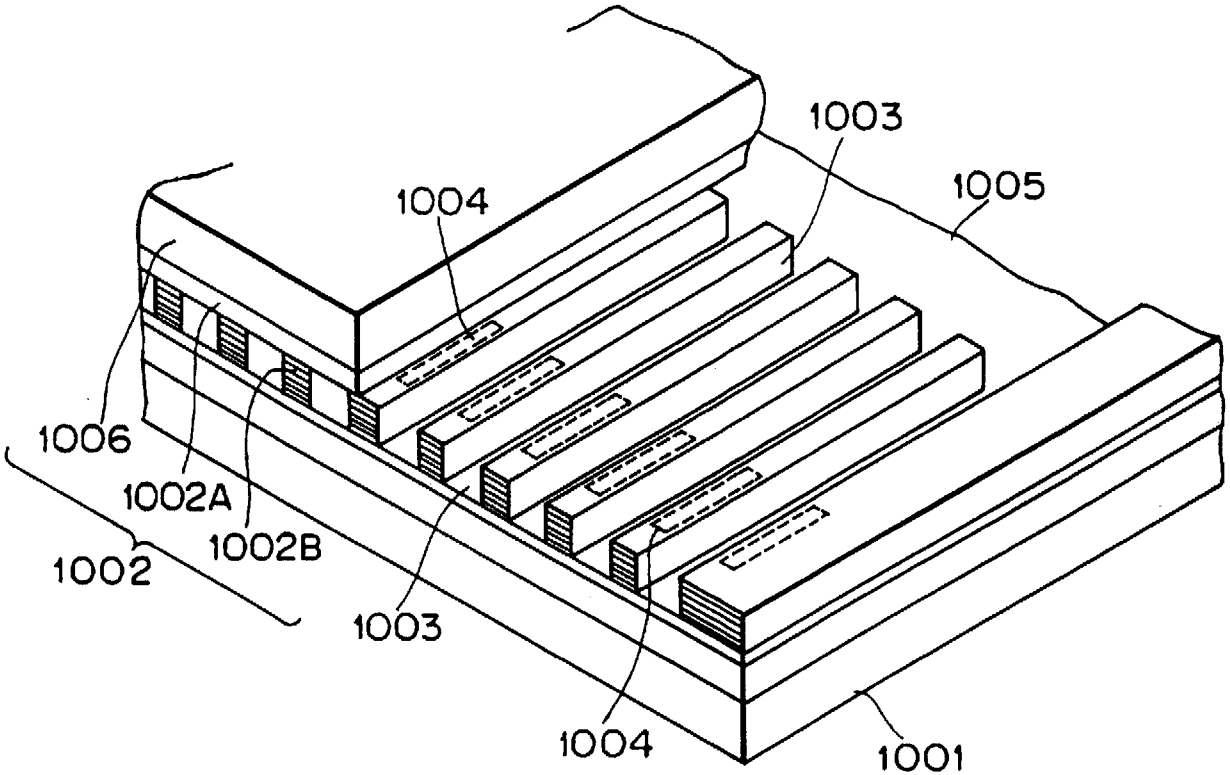
FIG. 17 is a perspective view for schematically indicating another example of a printing head to which the present invention is applicable.
Figure 18:
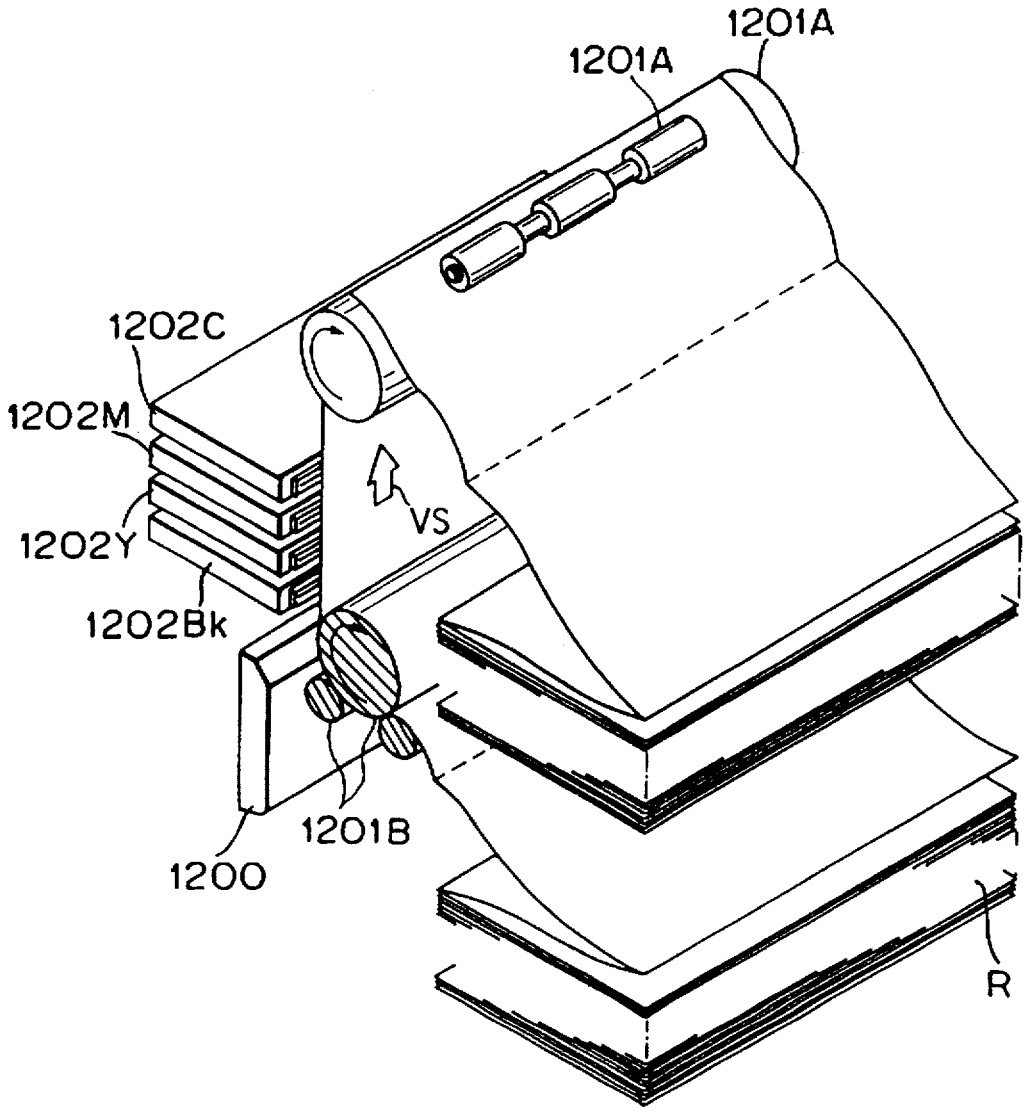
FIG. 18 is a perspective view for schematically representing an example of a printing apparatus arranged by employing the printing head of FIG. 17.

Alternatively, according to the present invention, it is possible to arrange such a line printer as illustrated in FIG. 18, in which a printing head with a structure of FIG. 17 is employed, and also the above-described printing element information detecting apparatus, driving circuit, and control system are utilized.

FIG. 17 schematically shows a so-called "full line" type printing head with such a structure that several hundreds to several thousands of ink jetting ports are aligned corresponding to the entire width of the recording medium.

In this printing head, a heat radiation resistive member 1004 is manufactured on a substrate 1001 together with a wiring pattern by utilizing such a manufacturing process similar to the thin film resistive member manufacturing process in the semiconductor integrated circuit fabrication. This heat radiation resistive element 1004 functions as a heating element that is energized to produce thermal energy. This thermal energy causes the situation changes in the ink due to the thermal sublimation phenomenon, thereby producing bubble therein for ejecting ink. Reference numeral 1002A indicates a liquid path forming member for forming an ink jet port 1002 and a liquid path 1003 communicated with this ink jet port 1002 in correspondence with the heating element 1004. The liquid path forming member 1002A is constructed of an upper plate 1006, an adhesive layer 1002A, and a wall member 1002B. Furthermore, there are fabricated a heat storage layer and a protection layer on the substrate 1001. Reference numeral 1005 indicates a liquid chamber commonly communicated with the respective liquid paths 1003, which stores ink supplied from an ink supply source (not shown).

In FIG. 18, reference numerals 1201A and 1201B show a pair of rollers functioning as transport means employed so as to hold/transport a recording medium R along the sub-scanning or transport direction VS. Reference numerals 1202BK, 1202Y 1202M and 1202C denote full multicolor type recording heads in which the nozzles are arranged over the entire width of the recording medium R, and color recording of black, yellow, magenta and cyan is performed. As shown in FIG. 18, the black recording head, yellow recording head, and magenta recording head are arranged in this order in the transport direction of the recording medium, so as to constitute a head assembly. Reference numeral 1200 indicates ink-ejecting recovery means containing a cap, an ink absorbing member, and a wiping blade located opposite to the recording heads 1202BK to 1202C instead of the recording medium R.

Figure 19A:
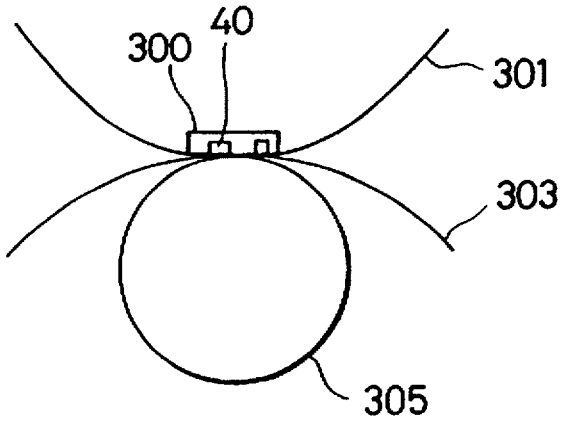
FIGS. 19A and 19B schematically represent two further examples of the printing apparatus arranged by employing the printing head driving apparatus, the printing head, and the control system thereof according to the present invention.
Figure 19B:
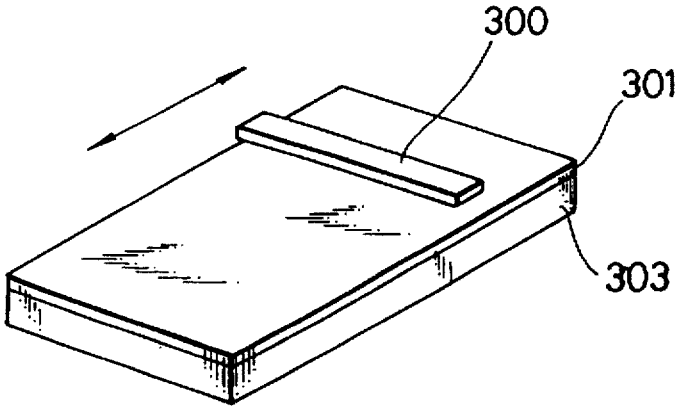

Also, a full line thermal head 300 is constituted by employing such a printing head driving apparatus 40 as shown in FIG. 10, such a printing element information detecting apparatus as indicated in FIG. 5, or a printing head driving apparatus as denoted in FIG. 14. With employment of this thermal head 300, it is also possible to construct a thermal head as represented in FIG. 19A, or FIG. 19B. In the apparatus of FIG. 19A, both of a color member donor sheet 301 and a plate sheet (color member accepting sheet) 303 are transported by employing a roller 305 with respect to the thermal heat 300. In FIG. 19B, the thermal head 300 is scanned with respect to the color member donor sheet 301 and the plate sheet 303. As a result, these printing head apparatuses may perform gradation recording operation in response to various sorts of image signals.

[FURTHER DESCRIPTION]

The present invention achieves distinct effects when applied to a recording head or a recording apparatus which has means for generating thermal energy such as electrothermal transducers or laser sources, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As previously described, in accordance with one aspect of the present invention, the initial shading is corrected based upon the pressure values detected by the pressure sensor, and/or the temperature increasing shading as well as the time-lapse shading are corrected in accordance with the amount of electric charges stored in the CCD elements. As a consequence, an image without shading can be printed out while maintaining the better image quality.

Also, according to another aspect of the present invention, the printing head driving apparatus employs such an analog shift register equipped with a series of CCD elements in order that the image data are transferred, aligned, and driven in correspondence with the respective printing elements. Furthermore, this CCD element is commonly used with such a CCD element capable of storing and transferring the temperature data, so that a compact printing head driving apparatus with low cost can be achieved.

According to further aspect of the invention, since the electric charges stored in the CCD elements are discharged prior to the transfer operation of the data to be printed out, such unnecessary charges stored in these CCD elements, caused by the dark current, can be previously discharged, so that a desired image with better image quality can be printed out.

According to a still further aspect of the present invention, since the data corresponding to the drive energy determined to each of the CCD elements is set to the respective CCD elements, even when the different driving conditions are set to the respective printing elements and also the data used for the gradation display is set, the entire circuit arrangement of the driving circuit can be made simple.

What is claimed is:

1. A printing element information detecting apparatus for detecting information regarding a plurality of printing elements of a printing head, the printing elements comprises a plurality of heating elements capable of producing thermal energy for applying a printing agent to a printing medium, said printing element information detecting apparatus comprising:

a plurality of temperature detecting means, provided in correspondence with said plurality of printing elements, for respectively detecting temperature information regarding said plurality of printing elements; and a plurality of CCD elements, provided in correspondence with said plurality of temperature detecting means, for storing electric charges whose quantity is proportional to the temperature information, and for successively transferring the electric charges so as to serial-transfer the temperature information.

2. A printing element information detecting apparatus as claimed in claim 1, wherein both of said plural temperature detecting means and said plural CCD elements are fabricated on a substrate on which said plurality of printing elements are formed.

3. A printing element information detecting apparatus as claimed in claim 2, wherein each of said plurality of temperature detecting means are arranged near each of said printing elements.

4. A printing head driving apparatus comprising:

a printing element information detecting apparatus for detecting information regarding a plurality of printing elements of a printing head, the printing elements comprising a plurality of heating elements capable of producing thermal energy for applying a printing agent to a printing medium, said printing element information detecting apparatus having:

a plurality of temperature detecting means, provided in correspondence with said plurality of printing elements, for respectively detecting temperature information regarding said plurality of printing elements; and a plurality of CCD elements, provided in correspondence with said plurality of temperature detecting means, for storing electric charges whose quantity is proportional to the temperature information, and for successively transferring the electric charges so as to serial-transfer the temperature information; and a shift register for aligning print data which is determined in accordance with the temperature information detected by said temperature detecting means and serial-transferred, in correspondence with an array of said plurality of printing elements of said printing head.

5. A printing head driving apparatus as claimed in claim 4, wherein said shift register is formed as an analog shift register having a plurality of CCD elements for sequentially transferring electric charges.

6. A printing head driving apparatus as claimed in claim 5, wherein said plurality of CCD elements included in said printing element information detecting apparatus is commonly used with said plurality of CCD elements contained in said analog shift register.

7. A printing head driving apparatus as claimed in claim 5, further comprising:

means for causing said plurality of CCD elements contained in said printing element information detecting apparatus to be disc barged prior to said detection, and/or for causing said plurality of CCD elements contained in said analog shift register to be discharged prior to said transfer.

8. A printing apparatus for performing an on-demand printing operation with an ink jet printing head having a plurality of ink jet ports for ejecting a liquid in response to a pressure effect based on the on-demand printing operation and a plurality of printing elements for producing the pressure for effecting the liquid, said printing apparatus comprising:

pressure detecting means for detecting the pressure when said printing elements are driven individually; and control means for controlling driving operations of said printing elements in response to information regarding the detected pressure.

9. A printing apparatus as claimed in claim 8, wherein:

said ink jet printing head comprises a plurality of liquid paths, one end of each of which is communicated with one of said ink ejecting ports and another end of which is communicated with a common liquid chamber;

said pressure detecting means is arranged in said common liquid chamber; and said control means acquires correction information used to control the driving operations of said printing elements in response to the information regarding pressure detected by said pressure detecting means when said plurality of printing elements are sequentially driven.

10. A printing apparatus as claimed in claim 9, wherein each of said printing elements comprises a heating element for generating thermal energy to produce a bubble within said liquid path and for ejecting the liquid in response to the bubble producing pressure.

11. A printing apparatus as claimed in claim 10, further comprising:

a printing element information detecting apparatus for detecting information regarding the plurality of printing elements of said printing head, said printing element information detecting apparatus including:

a plurality of temperature detecting means for detecting temperature information regarding said plurality of printing elements; and a plurality of CCD elements, provided in correspondence with said plurality of temperature detecting means, for storing electric charges whose quantity is proportional to the temperature information, and for successively transferring the electric charges so as to serial-transfer the temperature information.

12. A printing apparatus as claimed in claim 11, further comprising:

a shift register for aligning print data which is determined in accordance with the temperature information detected by said temperature detecting means and serial-transferred, in correspondence with an array of said plurality of printing elements of said printing head.

13. A printing apparatus as claimed in claim 8, wherein said control means controls the driving operations of said printing elements with an initial correcting value of a respective one of said printing elements, said correcting value being in correspondence with the information detected by driving said printing elements individually prior to a printing operation.

14. A method for detecting information regarding a plurality of printing elements of a printing head, the printing elements comprising a plurality of heating elements capable of producing thermal energy for applying a printing agent to a printing medium, said method comprising the steps of:

providing a plurality of temperature detecting means, provided in correspondence with said plurality of printing elements, for detecting temperature;

providing a plurality of CCD elements in correspondence with said plurality of temperature detecting means;

detecting temperature information regarding said plurality of printing elements with said plurality of temperature detecting means;

storing electric charges whose quantity is proportional to the temperature information in said plurality of CCD elements; and successively transferring the electric charges so as to serial-transfer the temperature information with said plurality of CCD elements.

15. A printing element information detecting method as claimed in claim 14, wherein both of said plural temperature detecting means and said plural CCD elements are fabricated on a substrate on which said plurality of printing elements are formed.

16. A printing element information detecting method as claimed in claim 15, wherein each of said plurality of temperature detecting means are arranged near each of said printing elements.

17. A method for driving a printing head comprising the steps of:

detecting information regarding a plurality of printing elements of a printing head, the printing elements comprising a plurality of heating elements capable of producing thermal energy for applying a printing agent to a printing medium, said detecting step comprising the steps of:

providing a plurality of temperature detecting means, provided in correspondence with said plurality of printing elements, for detecting temperature;

providing a plurality of CCD elements in correspondence with said plurality of temperature detecting means;

detecting temperature information regarding said plurality of printing elements with said plurality of temperature detecting means;

storing electric charges whose quantity is proportional to the temperature information in said plurality of CCD elements; and successively transferring the electric charges so as to serial-transfer the temperature information with said plurality of CCD elements;

providing a shift register; and aligning print data which is determined in accordance with the temperature information detected by said temperature detecting means and serial-transferred by said plurality of CCD elements, in correspondence with an array of said plurality of printing elements of said printing head, with said shift register.

18. A printing head driving method as claimed in claim 17, wherein said shift register is formed as an analog shift register having a plurality of CCD elements for sequentially transferring electric charges.

19. A printing head driving method as claimed in claim 18, wherein said plurality of CCD elements in correspondence with said plurality of temperature detecting means is commonly used with said plurality of CCD elements contained in said analog shift register.

20. A printing head driving method as claimed in claim 18, further comprising at least one of the steps of causing said plurality of CCD elements in correspondence with said plurality of temperature detecting means to be discharged prior to said detection, and causing said plurality of CCD elements contained in said analog shift register to be discharged prior to said transfer.

21. A printing method for performing an on-demand printing operation with an ink jet printing head having a plurality of ink jet ports for ejecting a liquid in response to a pressure effect based on the on-demand printing operation and a plurality of printing elements for producing the pressure for ejecting the liquid, said printing method comprising the steps of:

detecting the pressure when the printing elements are driven individually; and controlling driving operations of said printing elements in response to information regarding the detected pressure.

22. A printing method as claimed in claim 21, wherein:

said ink jet printing head comprises a plurality of liquid paths, one end of each of which is communicated with one of said ink ejecting ports and another end of which is communicated with a common liquid chamber;

means for detecting said pressure used in said detecting step is arranged in said common liquid chamber; and in said controlling step correction information used to control the driving operations of said printing elements are acquired in response to the information regarding pressure detected in said pressure detecting step when said plurality of printing elements are sequentially driven.

23. A printing method as claimed in claim 21, wherein each of said printing elements comprises a heating element for generating thermal energy to produce a bubble within said liquid path and for ejecting the liquid in response to the bubble producing pressure.

24. A printing method as claimed in claim 21, further comprising the step of:

detecting information regarding the plurality of printing elements of the printing head, said information detecting step including the steps of:

providing a plurality of temperature detecting means for detecting temperature;

providing a plurality of CCD elements in correspondence with said plurality of temperature detecting means;

detecting temperature information regarding said plurality of printing elements with said plurality of temperature detecting means;

storing electric charges whose quantity is proportional to the temperature information in said plurality of CCD elements; and successively transferring the electric charges so as to serial-transfer the temperature information with said plurality of CCD elements.

25. A printing method as claimed in claim 24, further comprising the steps of:

providing a shift register; and aligning print data which is determined in accordance with the temperature information detected by said temperature detecting means and serial-transferred by said plurality of CCD elements, in correspondence with an array of said plurality of printing elements of said printing head, with said shift register.

26. A method as claimed in claim 21, wherein said controlling step controls the driving operations of said printing elements with an initial correcting value of a respective one of said printing elements, said correcting value being in correspondence with the information detected by driving said printing elements individually prior to a printing operation.

27. A printing head driving apparatus comprising:

an analog shift register including a plurality of CCD elements for aligning print data which is serial-transferred, in correspondence with an arrangement of plural printing elements of a printing head; and means for causing said plurality of CCD elements to be discharged prior to the serial transfer operation of the print data.

28. A printing head driving apparatus as claimed in claim 27, wherein said printing head comprises an ink jet head in which a plurality of ink jet ports are arranged.

29. A printing head driving apparatus as claimed in claim 27, wherein said printing head includes means for producing thermal energy for applying a printing agent to a printing medium.

30. A printing head driving apparatus comprising:

an analog shift register including a plurality of CCD elements for aligning print data which is serial-transferred, in correspondence with an arrangement of plural printing elements of a printing head;

means for determining driving energy data for each of said plural printing elements; and means for transferring to said plurality of CCD elements, a group of data in response to the driving energy data determined by said determining means for each of said plural printing elements.

31. A printing head driving apparatus as claimed in claim 30, wherein said driving energy data is a pulse width.

32. A printing head driving apparatus as claimed in claim 30, wherein:

each of said plural printing elements is driven by subdivided plural times so as to form a single pixel; and the driving energy corresponds to a value obtained by multiplying a width of a driving pulse per one time, which is uniformly determined as to said plurality of printing elements, by a number of drivings determined as to each of said plurality of printing elements.

33. A printing head driving apparatus as claimed in claim 30, further comprising:

means for causing said plurality of CCD elements to be discharged prior to transfer operation of said print data.

34. A printing head driving apparatus as claimed in claim 30, wherein said printing head is in the form of an ink jet head in which a plurality of ink jet ports are arranged.

35. A printing head driving apparatus as claimed in claim 30, wherein said printing head includes means for producing thermal energy utilized to apply a printing agent to a printing medium.

36. A printing apparatus comprising:

an analog shift register including a plurality of CCD elements for aligning print data which is serial-transferred, in correspondence with an arrangement of plural printing elements of a printing head;

means for causing said plurality of CCD elements to be discharged prior to the serial transfer operation of said print data; and means for relatively transporting a printing medium to said printing head.

37. A printing apparatus comprising:

an analog shift register including a plurality of CCD elements for aligning print data which is serial-transferred, in correspondence with an arrangement of plural printing elements of a printing head;

means for determining driving energy data for each of said plural printing elements;

means for transferring to said plurality of CCD elements, a group of data in response to the driving energy determined by said determining means for each of said plural printing elements; and means for relatively transporting a printing medium to said printing head.

38. A method for driving a printing head comprising the steps of:

providing an analog shift register including a plurality of CCD elements;

aligning print data which is serial-transferred, in correspondence with an arrangement of plural printing elements of a printing head, by using said analog shift register; and causing said plurality of CCD elements to be discharged prior to the serial transfer operation of the print data.

39. A printing head driving method as claimed in claim 38, wherein said printing head comprises an ink jet head in which a plurality of ink jet ports are arranged.

40. A printing head driving method as claimed in claim 38, wherein said printing head includes means for producing thermal energy for applying a printing agent to a printing medium.

41. A method for driving a printing head comprising the steps of:

providing an analog shift register including a plurality of CCD elements;

aligning print data which is serial-transferred, in correspondence with an arrangement of plural printing elements of a printing head, by using said analog shift register; and transferring to said plurality of CCD elements, a group of data in response to driving energy data determined for each of said plural printing elements.

42. A printing head driving method as claimed in claim 41, wherein said driving energy data is a pulse width.

43. A printing head driving method as claimed in claim 41, wherein:

each of said plural printing elements is driven by subdivided plural times so as to form a single pixel; and the driving energy corresponds to a value obtained by multiplying a width of a driving pulse per one time, which is uniformly determined as to said plurality of printing elements, by the number of driving determined as to each of said plurality of printing elements.

44. A printing head driving method as claimed in claim 41, further comprising the step of causing said plurality of CCD elements to be discharged prior to transfer operation of said print data.

45. A printing head driving method as claimed in claim 41, wherein said printing head comprises an ink jet head in which a plurality of ink jet ports are arranged.

46. A printing head driving method as claimed in claim 41, wherein said printing head includes means for producing thermal energy for applying a printing agent to a printing medium.

47. A printing method comprising the steps of:

providing an analog shift register including a plurality of CCD elements;

aligning print data which is serial-transferred, in correspondence with an arrangement of plural printing elements of a printing head, by using said analog shift register;

causing said plurality of CCD elements to be discharged prior to the serial transfer operation of said print data; and relatively transporting a printing medium to the printing head.

48. A printing method comprising:

providing an analog shift register including a plurality of CCD elements;

aligning print data which is serial-transferred, in correspondence with an arrangement of plural printing elements of a printing head, by using said analog shift register;

transferring to said plurality of CCD elements, a group of data in response to driving energy determined for each of said plural printing elements; and relatively transporting a printing medium to the printing head.

* * * * *

UNITED STATES PATENT AND TRADEMARK OFFICE

CERTIFICATE OF CORRECTION

PATENT NO. : 5,734,391 Page 1 of 2

DATED : March 31, 1998

INVENTOR(S) : HIDEKI TANAKA ET AL.

It is certified that error appears in the above-identified patent and that said Letters Patent is hereby corrected as shown below:

On the title page: Item

[56] References Cited:

In FOREIGN PATENT DOCUMENTS, "1235366" should read --1-235366--.

COLUMN 1:

Line 42, "1) initial" should read --1) Initial--.

COLUMN 13:

Line 29, "unit" should read --units--.

Line 34, "the" should be deleted.

COLUMN 23:

Line 63, "opposing" should read --opposition--.

COLUMN 27:

Line 50, "comprises" should read --comprising--.

COLUMN 28:

Line 45, "disc barged" should read --discharged--.

Line 54, "effecting" should read --ejecting--.

UNITED STATES PATENT AND TRADEMARK OFFICE

CERTIFICATE OF CORRECTION

PATENT NO. : 5,734,391 Page 2 of 2

DATED : March 31, 1998

INVENTOR(S) : HIDEKI TANAKA ET AL.

It is certified that error appears in the above-identified patent and that said Letters Patent is hereby corrected as shown below:

COLUMN 32:

Line 19, "said" should read --the--.

Line 21, "is in the form of" should read --comprises--.

Line 25, "utilized to apply" should read --for applying--.

Signed and Sealed this

Fifth Day of January, 1999

*Attest:*

*Attesting Officer*

*Acting Commissioner of Patents and Trademarks*